US009133705B2

(12) United States Patent
Angeles Boza et al.

(10) Patent No.: US 9,133,705 B2
(45) Date of Patent: Sep. 15, 2015

(54) COMMUNICATIONS MODULE FOR ALTERNATE PATH GRAVEL PACKING, AND METHOD FOR COMPLETING A WELLBORE

(75) Inventors: Renzo Moises Angeles Boza, Houston, TX (US); Tracy J. Moffett, Sugar Land, TX (US); Pavlin B. Entchev, Houston, TX (US); Charles S. Yeh, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 313 days.

(21) Appl. No.: 13/695,563

(22) PCT Filed: Nov. 2, 2011

(86) PCT No.: PCT/US2011/058991

§ 371 (c)(1),
(2), (4) Date: Oct. 31, 2012

(87) PCT Pub. No.: WO2012/082248

PCT Pub. Date: Jun. 21, 2012

(65) Prior Publication Data

US 2013/0248172 A1 Sep. 26, 2013

Related U.S. Application Data

(60) Provisional application No. 61/423,914, filed on Dec. 16, 2010.

(51) Int. Cl.
*E21B 43/04* (2006.01)
*E21B 47/12* (2012.01)
(Continued)

(52) U.S. Cl.
CPC ..... *E21B 47/12* (2013.01); *E21B 43/04* (2013.01); *E21B 43/08* (2013.01); *E21B 47/01* (2013.01); *E21B 47/122* (2013.01)

(58) Field of Classification Search
CPC ..... E21B 47/12; E21B 43/04; E21B 47/122; E21B 43/08; E21B 47/01
See application file for complete search history.

(56) References Cited

U.S. PATENT DOCUMENTS 3,963,076 A 6/1976 Winslow
4,401,158 A 8/1983 Spencer et al.
(Continued)

FOREIGN PATENT DOCUMENTS

EP 0 601 724 6/1994

OTHER PUBLICATIONS

Hurst, et al. (2004), "Alternate Path Completions: A Critical Review and Lessons Learned from Case Histories with Recommended Practices for Deepwater Applications," SPE 86532, Intl. Symposium and Exh. on Formation Damage Control, Lafayette, LA., Feb. 18-20, 2004, pp. 1-15.
Hecker, M. T., et al. (2004), "Reducing Well Cost by Gravel Packing in Nonaqueous Fluid," SPE 90758, Ann. Tech. Conf. and Exh., Houston, TX., Sep. 26-29, 2004, pp. 1-7.
(Continued)

*Primary Examiner* — Daniel P Stephenson
(74) *Attorney, Agent, or Firm* — ExxonMobil Upstream Research-Law Department

(57) ABSTRACT

A communications module and methods for downhole operations having utility with production of hydrocarbon fluids from a wellbore, including at least one alternate flow channel and an electrical circuit. Generally, the electrical circuit is pre-programmed to (i) receive a signal and, in response to the received signal, deliver an actuating command signal. The communications module further has a transmitter-receiver. The communications module allows a downhole tool to be actuated within a completion interval of a wellbore without providing an electric line or a working string from the surface. The tool may be actuated in response to a reading from a sensing tool, or in response to a signal emitted in the wellbore by a downhole carrier, or information tag.

47 Claims, 9 Drawing Sheets

(51) Int. Cl.
*E21B 47/01* (2012.01)
*E21B 43/08* (2006.01)

(56) References Cited

U.S. PATENT DOCUMENTS

| | | | | |
|---|---|---|---|---|
| 4,945,991 | A | 8/1990 | Jones | |
| 5,082,052 | A | 1/1992 | Jones et al. | |
| 5,113,935 | A | 5/1992 | Jones et al. | |
| 5,333,688 | A | 8/1994 | Jones et al. | |
| 5,343,949 | A | 9/1994 | Ross et al. | |
| 5,350,018 | A | 9/1994 | Sorem et al. | |
| 5,355,953 | A | 10/1994 | Shy et al. | |
| 5,375,662 | A | 12/1994 | Echols, III et al. | |
| 5,396,954 | A | 3/1995 | Brooks | |
| 5,413,180 | A | 5/1995 | Ross et al. | |
| 5,476,143 | A | 12/1995 | Sparlin et al. | |
| 5,515,915 | A | 5/1996 | Jones et al. | |
| 5,588,487 | A | 12/1996 | Bryant | |
| 5,803,177 | A | 9/1998 | Hriscu et al. | |
| 5,868,200 | A | 2/1999 | Bryant et al. | |
| 5,890,533 | A | 4/1999 | Jones | |
| 5,909,774 | A | 6/1999 | Griffith et al. | |
| 5,934,376 | A | 8/1999 | Nguyen et al. | |
| 5,971,070 | A | 10/1999 | Ross et al. | |
| 6,056,061 | A | 5/2000 | Ross et al. | |
| 6,059,032 | A | 5/2000 | Jones | |
| 6,059,033 | A | 5/2000 | Ross et al. | |
| 6,227,303 | B1 | 5/2001 | Jones | |
| 6,298,916 | B1 | 10/2001 | Tibbles et al. | |
| 6,360,820 | B1 | 3/2002 | Laborde et al. | |
| 6,409,219 | B1 | 6/2002 | Broome et al. | |
| 6,446,729 | B1 | 9/2002 | Bixenman et al. | |
| 6,446,737 | B1 | 9/2002 | Fontana et al. | |
| 6,464,261 | B1 | 10/2002 | Dybevik et al. | |
| 6,505,682 | B2 | 1/2003 | Brockman | |
| 6,513,599 | B1 | 2/2003 | Bixenman et al. | |
| 6,516,882 | B2 | 2/2003 | McGregor et al. | |
| 6,557,634 | B2 | 5/2003 | Hailey, Jr. et al. | |
| 6,575,251 | B2 | 6/2003 | Watson et al. | |
| 6,588,506 | B2 | 7/2003 | Jones | |
| 6,666,274 | B2 | 12/2003 | Hughes | |
| 6,681,854 | B2 | 1/2004 | Danos | |
| 6,695,067 | B2 | 2/2004 | Johnson et al. | |
| 6,749,023 | B2 | 6/2004 | Nguyen et al. | |
| 6,749,024 | B2 | 6/2004 | Bixenman | |
| 6,752,207 | B2 | 6/2004 | Danos et al. | |
| 6,755,245 | B2 | 6/2004 | Nguyen et al. | |
| 6,766,862 | B2 | 7/2004 | Chatterji et al. | |
| 6,768,700 | B2 * | 7/2004 | Veneruso et al. | 367/81 |
| 6,789,624 | B2 | 9/2004 | McGregor et al. | |
| 6,814,139 | B2 | 11/2004 | Hejl et al. | |
| 6,817,410 | B2 | 11/2004 | Wetzel et al. | |
| 6,848,510 | B2 | 2/2005 | Bixenman et al. | |
| 6,883,608 | B2 | 4/2005 | Parlar et al. | |
| 6,923,262 | B2 | 8/2005 | Broome et al. | |
| 6,983,796 | B2 | 1/2006 | Bayne et al. | |
| 6,986,390 | B2 | 1/2006 | Doanne et al. | |
| 6,988,551 | B2 | 1/2006 | Evans | |
| 7,048,061 | B2 | 5/2006 | Bode et al. | |
| 7,066,251 | B2 | 6/2006 | Streater et al. | |
| 7,100,691 | B2 | 9/2006 | Nguyen et al. | |
| 7,104,324 | B2 | 9/2006 | Wetzel et al. | |
| 7,147,054 | B2 | 12/2006 | Wang et al. | |
| 7,152,677 | B2 | 12/2006 | Parlar et al. | |
| 7,207,383 | B2 | 4/2007 | Hurst et al. | |
| 7,243,715 | B2 | 7/2007 | Wang et al. | |
| 7,243,723 | B2 | 7/2007 | Surjaatmadja et al. | |
| 7,243,724 | B2 | 7/2007 | McGregor et al. | |
| 7,243,732 | B2 | 7/2007 | Richard | |
| 7,264,061 | B2 | 9/2007 | Dybevik et al. | |
| 7,278,479 | B2 | 10/2007 | Kvernstuen et al. | |
| 7,343,983 | B2 | 3/2008 | Livingstone | |
| 7,363,974 | B2 | 4/2008 | Wang et al. | |
| 7,370,700 | B2 | 5/2008 | Hurst et al. | |
| 7,407,007 | B2 | 8/2008 | Tibbles | |
| 7,426,962 | B2 | 9/2008 | Moen et al. | |
| 7,431,058 | B2 | 10/2008 | Holting | |
| 7,431,085 | B2 | 10/2008 | Coronado et al. | |
| 7,441,605 | B2 | 10/2008 | Coronado et al. | |
| 7,493,959 | B2 | 2/2009 | Johnson et al. | |
| 7,562,709 | B2 | 7/2009 | Saebi et al. | |
| 7,584,799 | B2 | 9/2009 | Coronado et al. | |
| 7,591,321 | B2 | 9/2009 | Whitsitt et al. | |
| 7,597,141 | B2 | 10/2009 | Rouse et al. | |
| 7,703,507 | B2 | 4/2010 | Strickland | |
| 7,814,970 | B2 | 10/2010 | Strickland | |
| 7,874,364 | B2 | 1/2011 | Redlinger et al. | |
| 7,938,184 | B2 | 5/2011 | Yeh et al. | |
| 8,011,437 | B2 | 9/2011 | Yeh et al. | |
| 8,037,934 | B2 | 10/2011 | Strickland | |
| 8,151,910 | B2 | 4/2012 | Swinford | |
| 8,162,051 | B2 | 4/2012 | Strickland | |
| 8,186,429 | B2 | 5/2012 | Yeh et al. | |
| 8,215,406 | B2 | 7/2012 | Dale et al. | |
| 8,235,127 | B2 * | 8/2012 | Patel et al. | 166/380 |
| 8,245,782 | B2 * | 8/2012 | Sanchez | 166/278 |
| 8,267,173 | B2 * | 9/2012 | Clarkson et al. | 166/278 |
| 8,272,439 | B2 | 9/2012 | Strickland | |
| 8,839,850 | B2 * | 9/2014 | Algeroy et al. | 166/65.1 |
| 8,910,716 | B2 * | 12/2014 | Newton et al. | 166/373 |
| 2002/0174984 | A1 | 11/2002 | Jones | |
| 2003/0000700 | A1 | 1/2003 | Hailey, Jr. | |
| 2003/0173075 | A1 | 9/2003 | Morvant et al. | |
| 2004/0003922 | A1 | 1/2004 | Bayne et al. | |
| 2004/0074641 | A1 | 4/2004 | Hejl et al. | |
| 2004/0140089 | A1 | 7/2004 | Gunneroed | |
| 2005/0009249 | A1 | 1/2005 | Oh et al. | |
| 2005/0028977 | A1 | 2/2005 | Ward | |
| 2005/0039917 | A1 | 2/2005 | Hailey, Jr. | |
| 2005/0045329 | A1 | 3/2005 | Wetzel et al. | |
| 2005/0061501 | A1 | 3/2005 | Ward et al. | |
| 2005/0067170 | A1 | 3/2005 | Richard | |
| 2005/0082060 | A1 | 4/2005 | Ward et al. | |
| 2005/0082061 | A1 | 4/2005 | Nguyen et al. | |
| 2005/0087346 | A1 | 4/2005 | Bixenman et al. | |
| 2005/0092485 | A1 | 5/2005 | Brezinski et al. | |
| 2005/0178562 | A1 | 8/2005 | Livingstone | |
| 2005/0205269 | A1 | 9/2005 | Kilgore et al. | |
| 2005/0284643 | A1 | 12/2005 | Setterberg, Jr. | |
| 2006/0124297 | A1 | 6/2006 | Ohmer | |
| 2007/0084608 | A1 | 4/2007 | Bixenman et al. | |
| 2007/0205021 | A1 | 9/2007 | Pelletier et al. | |
| 2009/0025923 | A1 | 1/2009 | Patel et al. | |
| 2009/0120641 | A1 | 5/2009 | Yeh et al. | |
| 2009/0223663 | A1 | 9/2009 | Snider et al. | |
| 2009/0277690 | A1 | 11/2009 | Swinford | |
| 2009/0283279 | A1 | 11/2009 | Patel et al. | |
| 2010/0032158 | A1 | 2/2010 | Dale et al. | |
| 2010/0065284 | A1 | 3/2010 | Freyer | |
| 2010/0200244 | A1 | 8/2010 | Purkis | |
| 2010/0314174 | A1 | 12/2010 | Denoix et al. | |
| 2011/0139465 | A1 * | 6/2011 | Tibbles et al. | 166/387 |
| 2011/0266066 | A1 | 11/2011 | Viel et al. | |
| 2011/0284233 | A1 | 11/2011 | Wu et al. | |
| 2011/0297380 | A1 | 12/2011 | Alberty et al. | |
| 2013/0248172 | A1 * | 9/2013 | Angeles Boza et al. | 166/250.01 |
| 2013/0277053 | A1 * | 10/2013 | Yeh et al. | 166/278 |
| 2014/0076580 | A1 * | 3/2014 | Holderman et al. | 166/380 |

OTHER PUBLICATIONS

Powers, B.S., et al. (2006), "A Critical Review of Chirag Field Completions Performance—Offshore Azerbaijan B," SPE 98146, Intl. Symposium and Exh. on Formation Damage Control, Lafayette, LA, Feb. 15-17, 2006, pp. 1-13.

Barry, M.D., et al., (2007), "Openhole Gravel Packing with Zonal Isolation," SPE 110460, Ann. Tech. Conf.and Exh., Anaheim, CA, Nov. 11-14, 2007, pp. 1-10.

Petersen, et al., (2008), "A Survey of Wireless Technology for the Oil and Gas Industry," SPE 112207 Intelligent Energy Conf. and Exh., Amsterdam, the Netherlands, Feb. 25-27, 2008, pp. 1-10.

Fraley, et al., (2007), "RFID Technology for Downhole Well Applications," Drilling & Well Technology, Marathon Oil Company, Expl. & Production—Oil & Gas Review, OTC Edition, pp. 1-2.

* cited by examiner

COMMUNICATIONS MODULE FOR ALTERNATE PATH GRAVEL PACKING, AND METHOD FOR COMPLETING A WELLBORE

CROSS REFERENCE TO RELATED APPLICATIONS

This application is the National Stage of International Application No. PCT/US2011/058991, filed Nov. 2, 2011, which claims the benefit of U.S. Provisional Application No. 61/423,914, filed Dec. 16, 2010, the entirety of which is incorporated herein by reference for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completions. More specifically, the present invention relates to wireless communication and control systems within a wellbore. The application further relates to the remote actuation of tools in connection with wellbores that have been completed using gravel-packing.

DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of certain areas of the formation behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented into place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A production string or "tubing" is then positioned inside the wellbore extending down below the last string of casing and across a subsurface formation.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of gravel packs eliminates the need for cementing, perforating, and post-perforation clean-up operations.

A common problem in open-hole completions is the immediate exposure of the wellbore to the surrounding formation. If the formation is unconsolidated or heavily sandy, the flow of production fluids into the wellbore may carry with it formation particles, e.g., sand and fines. Such particles can be erosive to production equipment downhole and to pipes, valves and separation equipment at the surface.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slotted openings. The base pipe is then typically wrapped or otherwise encompassed with a filtration medium such as a screen or wire mesh. This is referred to as a sand screen.

To augment sand control devices, particularly in open-hole completions, it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together forms a gravel slurry. The slurry dries in place, leaving a circumferential packing of gravel. The gravel not only aids in particle filtration but also helps maintain formation integrity.

In an open-hole gravel pack completion, the gravel is positioned between a sand screen that surrounds a perforated base pipe and a surrounding wall of the wellbore. During production, formation fluids flow from the subterranean formation, through the gravel, through the screen, and into the inner base pipe. The base pipe thus serves as a part of the production string.

In some cases, a gravel pack is placed along a completion interval in a cased hole. This is particularly advantageous in unconsolidated sandstone formations. In this instance, a sand screen surrounding a perforated base pipe is placed within the wellbore along the subsurface formation, and a gravel pack is installed between the sand screen and the surrounding perforated production casing. The resulting gravel pack restricts the invasion of sand and fines.

A problem historically encountered with gravel-packing is that an inadvertent loss of carrier fluid from the slurry during the delivery process can result in premature sand bridges being formed at various locations along open-hole intervals. For example, in an inclined production interval or an interval having an enlarged or irregular borehole, a poor distribution of gravel may occur due to a premature loss of carrier fluid from the gravel slurry into the formation. The fluid loss may then cause voids to form in the gravel pack. Thus, a complete gravel-pack from bottom to top is not achieved, leaving the wellbore exposed to sand and fines infiltration.

The problem of sand bridging has been addressed through the use of alternate path technology, or "APT." Alternate path technology employs shunt tubes (or shunts) that allow the gravel slurry to bypass sand bridges or selected areas along a wellbore. Such alternate path technology is described, for example, in U.S. Pat. No. 5,588,487 entitled "Tool for Blocking Axial Flow in Gravel-Packed Well Annulus," and PCT Publication No. WO2008/060479 entitled "Wellbore Method and Apparatus for Completion, Production, and Injection," each of which is incorporated herein by reference in its entirety. An additional reference which discuss alternate path technology is M. D. Barry, et al., "Open-hole Gravel Packing with Zonal Isolation," SPE Paper No. 110,460 (November 2007).

In connection with alternate path sand screens, it has been proposed to utilize control lines and sensors. U.S. Pat. No. 7,441,605 entitled "Optical Sensor Use in Alternate Path Gravel Packing with Integral Zonal Isolation" offers devices and methods for monitoring wellbore conditions while conducting hydrocarbon production within an open-hole wellbore along multiple zones. There, a production tubing string assembly is provided with a plurality of packers ostensibly suitable for sealing between multiple individual zones downhole. The packers are set using hydraulic fluid pressure present within the bore of the production tubing string. In addition to the packers, the production tubing string includes production nipples having perforated screens for the removal of debris from produced fluids. One or more fiber optic sensor lines are disposed upon the outside of the screens. The sensor lines are disposed through the packers using a pass-through system to provide unbroken sensing line(s) to the surface of the wellbore. This allows temperature, pressure, or other wellbore conditions to be monitored at the surface in each of the individual zones of interest. In addition, hydraulic control lines are disposed upon the outside of the screen to facilitate post-deployment fiber optic installation.

There are additional references that discuss control lines, including fiber optic lines, in an open-hole completion. These include U.S. Pat. No. 7,243,715; U.S. Pat. No. 7,431,085; U.S. Pat. No. 6,848,510; U.S. Pat. No. 6,817,410; and U.S. Pat. No. 6,681,854. However, these references require a physical path to provide communication from the surface to a downhole location, or vice versa. In subsea or extended reach wells, the complexity and reliability of such completions becomes a concern.

Therefore, a need exists for an improved sand control system that provides not only alternate flow path technology for gravel packing, but also an improved communication and control system. Further, a wireless system is needed in connection with sand control operations, particularly with alternate path sand screens.

SUMMARY OF THE INVENTION

A communications module for downhole operations is provided herein. The communications module has utility in connection with the production of hydrocarbon fluids from a wellbore. The wellbore may be completed with production casing, or may be an open-hole wellbore. The wellbore has a lower end defining a completion interval, which may extend through one, two, or more subsurface intervals.

In one embodiment, the communications module provides an inner mandrel. The inner mandrel is preferably dimensioned in accordance with a base pipe of a sand control device. Preferably, the inner body is fabricated from a non-metallic material such as ceramic or plastic.

The communications module may also comprise an outer shroud. The outer shroud is circumferentially disposed about the inner mandrel. The outer shroud preferably does not function as a filtering medium, but freely permits the flow of formation fluids there through. The outer shroud may be either concentric or eccentric to the inner mandrel.

The communications module also includes at least one alternate flow channel. The alternate flow channel represents one or more shunt tubes that are configured to provide a route for gravel slurry during a gravel packing operation. The gravel slurry will first flow in the annulus between the communications module and the surrounding wellbore. After that, the fluid phase in the slurry leaks off into the nearby reservoir formation or sand screens, and an annular pack is deposited in the annulus surrounding the communications module. Slurry will then bypass the communications module through alternate flow channels to provide gravel packing below the communications module.

The alternate flow channels may be, for example, a longitudinal annulus between outer and inner mandrels. The alternate flow channels may contain both transport tubes and packing tubes, where packing tubes are equipped with flow ports opening to the wellbore annulus for slurry exit. The alternate flow channels may also be, for example, transport tubes disposed between the inner mandrel and the surrounding outer shroud. Alternatively still, the alternate flow channels may be a longitudinal annulus between an outer shroud and an inner mandrel.

The communications module also has a transmitter-receiver. The transmitter-receiver (i) receives a signal, and (ii) in response to the received signal, sends a separate instruction signal. The communications module further has an electrical circuit. Generally, the electrical circuit is programmed to (i) receive a signal and, in response to the received signal, deliver an actuating command signal.

In addition, the communications module includes a control line. The control line is configured to reside entirely within the subsurface completion interval of the wellbore and is not tied to the surface. The control line serves to convey an actuating command signal to a downhole tool. The downhole tool may be, for example, a sliding sleeve, a valve, or a packer. The control line operates in response to the command signal provided by the pre-programmed electrical circuit.

The communications module is configured to connect to a tubular joint in the wellbore. In one aspect, the tubular joint comprises a joint of a sand control device. The sand control device will have a sand screen equipped with alternate path channels.

In one embodiment, the transmitter-receiver is configured to (i) receive a signal from a downhole carrier and, (ii) in response to the received signal, send a separate instruction signal to the pre-programmed electrical circuit to actuate a downhole tool.

In one aspect, the communications module further comprises a sensing device. The sensing device may be a pressure gauge, a flow meter, a temperature gauge, a sand detector, an in-line tracer analyzer, a compaction strain detector, or combinations thereof. The sensing device is in electrical communication with the electrical circuit. Optionally, the electrical circuit is programmed to send a command signal to the control line to actuate the downhole tool in response to a selected reading by the sensing device.

In another aspect, the electrical circuit receives and records readings from the sensing device. The electrical circuit is pre-programmed to send a signal to the transmitter-receiver conveying the recorded readings. The transmitter-receiver, in turn, is programmed to (i) receive the recorded readings from the electrical circuit and, (ii) in response to the received recorded readings, wirelessly transmit the recorded readings to the downhole carrier.

A method for completing a wellbore is also disclosed herein. The method has utility in connection with the production of hydrocarbon fluids from a wellbore. The wellbore has a lower end defining a completion interval. The completion interval may extend through one, two, or more subsurface intervals.

In one embodiment, the method includes connecting a communications module to a tubular joint. The communications module may be in accordance with the communications module described above. The module will at least include alternate flow channels configured to provide an alternate flow path for a gravel slurry to partially bypass the communications module during a gravel packing procedure. This means that after gravel is packed in the annulus between the communications module and the surrounding wellbore, most slurry will bypass the communications module to provide gravel packing below the communications module.

The module will also have a control line. Beneficially, the control line is configured to reside entirely within the completion interval of the wellbore. The control line conveys an actuating command signal to a downhole tool within the wellbore.

The method will also include running the communications module and the connected tubular joint into the wellbore. The tubular joint may comprise a joint of a sand control device. The sand control device will have a sand screen with alternate flow channels. Alternatively, the tubular joint may be a packer with alternate path channels that can be set within the wellbore before a gravel packing operation begins. The communication module may also be built or embedded in a tubular joint.

The method also includes positioning the communications module and the tubular joint in the completion interval of the wellbore. Thereafter, the method includes injecting a gravel slurry into an annular region formed between the communications module and the surrounding wellbore as well as between the tubular joints and the surrounding wellbore. The gravel slurry travels through the at least one alternate flow channel in the tubular joints to allow the gravel slurry to at least partially bypass any premature sand bridges or zonal isolation in the annulus. In this way, gravel packing below the communications module is provided.

Preferably, the wellbore is completed for the production of hydrocarbon fluids. The method further includes producing production fluids from at least one subsurface interval along the completion interval of the wellbore for a period of time.

In one embodiment, the control line contains an electrical line. In this instance, the method may further comprise sending a signal from the electrical circuit through the electrical line to actuate the downhole tool. The downhole tool may be, for example, a sliding sleeve, a packer, or a valve.

The method preferably operates in conjunction with a downhole carrier. The downhole carrier is essentially an information tag that is pumped, dropped, or otherwise released into the wellbore. Information may flow from the downhole carrier to the transmitter-receiver, or from the transmitter-receiver to the downhole carrier. In either event, the information is beneficially exchanged within the wellbore during wellbore operations without need of an electric line or a working string.

In one aspect, the transmitter-receiver is programmed to (i) receive a wireless signal from the downhole carrier and, (ii) in response to the received signal, send a separate instruction signal to the pre-programmed electrical circuit to actuate the downhole tool.

The communications module may include a sensing device. The sensing device may be, for example, a pressure gauge, a flow meter, a temperature gauge, a sand detector, a strain gauge such as a compaction strain detector, or an in-line tracer analyzer. The sensing device is in electrical communication with the electrical circuit. In this instance, the method further includes recording a reading by the sensing device in the electrical circuit. The electrical circuit may then send a signal from the electrical circuit to the control line to actuate the downhole tool in response to a selected reading by the sensing device. Alternatively, the electrical circuit may send its signal to the transmitter-receiver, which in turn sends a signal containing the recorded readings to the downhole carrier.

A separate method for actuating a downhole tool in a wellbore is also provided herein. The wellbore again has a lower end defining a completion interval. The completion interval may be an open-hole portion.

In one embodiment, the method includes running a communications module and a connected tubular joint into the wellbore. The communications module may be in accordance with the communications module described above. The module will at least include alternate flow channels configured to permit a gravel slurry to partially bypass the blocked annulus adjacent to the communications module during a gravel packing procedure. In this way, gravel packing is provided below the communications module. The module will also have a control line configured to reside entirely within the open-hole (or other) portion of the wellbore. The control line conveys an actuating command signal to a downhole tool within the wellbore.

The method also includes positioning the communications module and the tubular joint in the completion interval of the wellbore. Preferably, the tubular joint is part of a sand control device with alternate path channels. The sand control device will have a filtering screen. The method will then further include injecting a gravel slurry into an annular region formed between the sand control device and the surrounding wellbore. The sand control device will also have at least one alternate flow channel to allow the gravel slurry to at least partially bypass the joint of the sand control device during the gravel packing operation in case the downstream annulus is blocked by premature sand bridge or a zonal isolation device.

After the communications module and the tubular joint are positioned, the method includes releasing a first downhole carrier into the wellbore. The downhole carrier is essentially an information tag that is pumped, dropped, or otherwise released into the wellbore. In this arrangement, the downhole carrier emits a first frequency signal. Thus, information flows from the downhole carrier to the transmitter-receiver within the wellbore. This may take place during wellbore operations without need of an electric line or a working string.

The method also includes sensing the first frequency signal at the transmitter-receiver. In response to the first frequency signal, a first instruction signal is sent from the transmitter-receiver to the electrical circuit.

The method further includes sending a first command signal from the electrical circuit. This is done in response to the first instruction signal to actuate a downhole tool. Actuating the downhole tool may comprise (i) moving a sliding sleeve to close off production from a selected zone within the completion interval, (ii) moving a sliding sleeve to open up production from a selected zone within the completion interval, (iii) or setting a packer.

Preferably, the communications module employs RFID technology. In such an embodiment, the pre-programmed electrical circuit is an RFID circuit. Further, the downhole carrier is an RFID tag that emits a radio-frequency signal, while the transmitter-receiver is an RF antenna.

Alternatively, the communications module employs acoustic technology. In such an instance, the downhole carrier comprises an acoustic frequency generator. The transmitter-receiver then comprises an acoustic antenna that receives acoustic signals from the downhole carrier, and in response sends an electrical signal to the pre-programmed electrical circuit.

In one embodiment, the method utilizes a second downhole carrier. In this instance, the method includes releasing a second downhole carrier into the wellbore. The second downhole carrier emits a second frequency signal. The second frequency signal is also sensed at the transmitter-receiver. In response to the second frequency signal, a second instruction signal is sent from the transmitter-receiver to the electrical circuit. Then, in response to the second instruction signal, a second command signal is sent from the electrical circuit to actuate a downhole tool.

The present disclosure also provides a method for monitoring conditions in a wellbore. The wellbore has a lower end defining a completion interval. The completion interval may be along a section of production casing, or within an open-hole portion. Monitoring takes place during hydrocarbon production operations after a gravel packing operation has been conducted.

In one embodiment, the method includes running a communications module and a connected tubular joint into the wellbore. The communications module may be in accordance with the communications module described above. The module will at least include alternate flow channels configured to permit the gravel slurry to partially bypass the communications module during a gravel packing procedure. In this way, gravel packing is provided below the communications module.

The communications module will also have a control line. Beneficially, the control line is configured to reside entirely within the open-hole portion of the wellbore. The control line conveys an actuating command signal to a downhole tool within the wellbore.

The method also includes positioning the communications module and the tubular joint in the open-hole portion of the wellbore. Preferably, the tubular joint is part of a sand control device. The sand control device will have a filtering screen, and will also have at least one alternate flow channel. The method will then further include injecting a gravel slurry into an annular region formed between the sand control device and the surrounding open-hole portion of the wellbore. The sand control device will also have at least one alternate flow channel to allow the gravel slurry to at least partially bypass the joint of the sand control device during the gravel packing operation.

The method further includes producing hydrocarbon fluids from the open-hole portion of the wellbore. During production, the method includes sensing a downhole condition. The downhole condition may be, for example, temperature, pressure, flow rate, or other parameters. Sensing takes place using a sensing device that is in electrical communication with an electrical circuit. The method then includes sending readings of the sensed downhole conditions from the sensing device to the electrical circuit.

The method also includes the steps of:

releasing a downhole carrier into the wellbore;

sending the readings from the electrical circuit to the transmitter-receiver;

sending the readings from the transmitter-receiver to the downhole carrier;

retrieving the downhole carrier from the wellbore; and downloading the recorded readings from the downhole carrier for analysis.

Different means may be employed for releasing the downhole carrier. In one instance, releasing the downhole carrier comprises releasing the downhole carrier from the open-hole portion of the wellbore at or below the communications module. This arrangement may include the use of a separate information tag. Thus, the method may include pumping a tag from a surface into the wellbore, the tag emitting a first frequency signal, sensing the first frequency signal at the transmitter-receiver, and in response to sensing the first frequency signal, releasing the downhole carrier into the wellbore.

Alternatively, releasing the downhole carrier may mean pumping the downhole carrier from a surface into the wellbore and down to the communications module.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
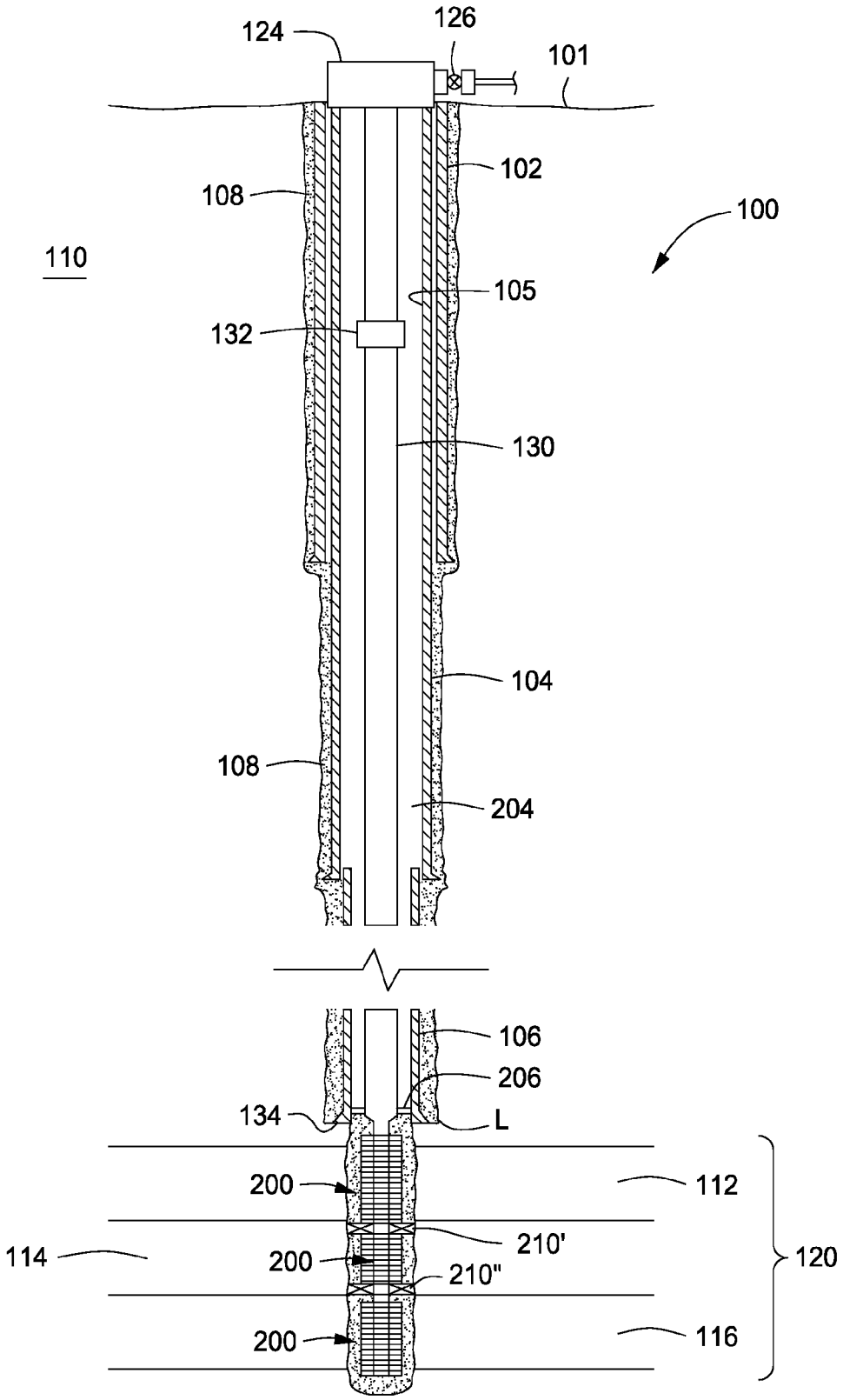
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well", when referring to an opening in the formation, may be used interchangeably with the term "wellbore."

The term "tubular member" refers to any pipe, such as a joint of casing, a portion of a liner, or a pup joint.

The term "sand control device" means any elongated tubular body that permits an inflow of fluid into an inner bore or a base pipe while filtering out sand, fines and granular debris from a surrounding formation.

The term "alternate flow channels" means any collection of manifolds and/or shunt tubes that provide fluid communication through or around a downhole device such as a sand screen, a packer, or a communications module, to allow a gravel slurry to at least partially bypass the device in order to obtain full gravel packing of an annular region below the device.

Description of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or "below" are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface is normally referred to as a "liner."

In the illustrative wellbore arrangement of FIG. 1, intermediate casing string 104 is hung from the surface 101, while casing string 106 is hung from a lower end of casing string 104. The lower casing string 106 terminates at 134. Additional intermediate casing strings (not shown) may be employed. The present inventions are not limited to the type of casing architecture used.

Each string of casing 102, 104, 106 is set in place through cement 108. The cement 108 isolates the various formations of the subsurface 110 from the wellbore 100 and each other. The cement 108 extends from the surface 101 to a depth "L" at a lower end of the casing string 106. It is understood that some intermediate casing strings may not be fully cemented.

An annular region 204 is formed between the production tubing 130 and the surrounding string of casing 106. A packer 206 seals the annular region 204 near the lower end "L" of the casing string 106.

In many wellbores, a final casing string known as production casing is cemented into place at a depth where subsurface production intervals reside. For example, a production liner (not shown) may be hung from the lower end 134 of intermediate casing string 106. The production liner would extend substantially down to a lower end 136 (not shown in FIG. 1, but shown in FIG. 2) of the open-hole portion 120 of the wellbore 100. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks, natural fractures connected to an aquifer, or fingering from injection wells. In this instance, there is a probability that water will invade the wellbore 100. In addition, undesirable condensable fluids such as hydrogen sulfide gas or acid gases may invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected zones or intervals. In the first instance, the operator will want to isolate the intermediate interval 114 from the production string 130 and from the upper 112 and lower 116 intervals so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114. Solutions to these needs in the context of an open-hole completion are provided herein, and are demonstrated more fully in connection with the proceeding drawings.

In connection with the production of hydrocarbon fluids from a wellbore having an open-hole completion, it is not only desirable to isolate selected intervals, but also to limit the influx of sand particles and other fines. In order to prevent the migration of formation particles into the production string 130 during operation, sand control devices 200 have been run into the wellbore 100. These are described more fully below in connection with FIG. 2 and with FIGS. 4A and 4B.

Figure 2:
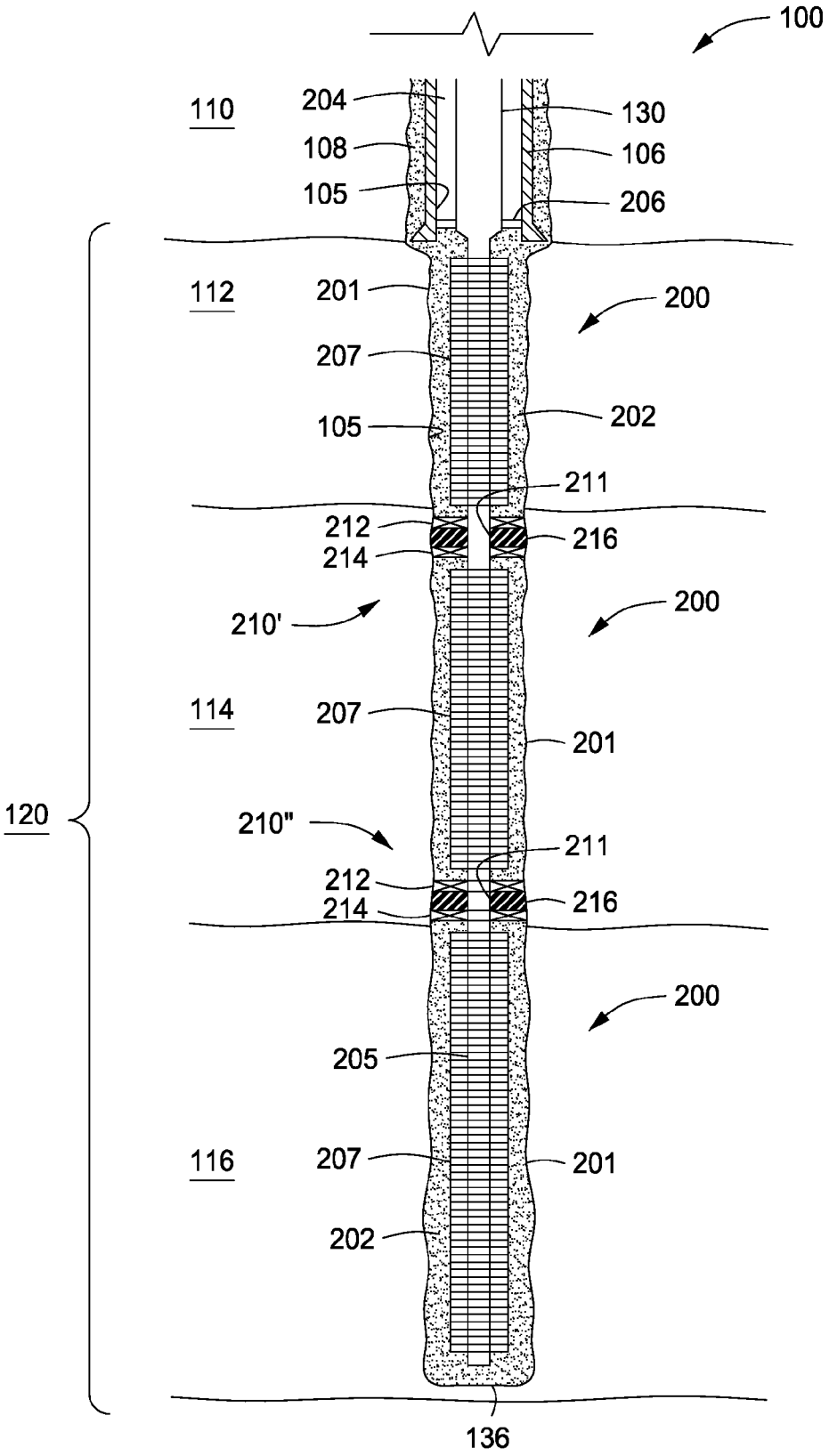
FIG. 2 is an enlarged cross-sectional view of an open-hole completion of the wellbore of FIG. 1. The open-hole completion at the depth of the three illustrative intervals is more clearly seen.

Referring now to FIG. 2, FIG. 2 is an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively. Finally, the sand control devices 200 along each of the intervals 112, 114, 116 are shown.

The sand control devices 200 contain an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207. The filter medium typically defines a metallic material wound or otherwise placed radially around the base pipes 205. The filter medium 207 is preferably a combination of wire-mesh screens or wire-wrapped screens fitted around the base pipe 205. The mesh or screens serve as filters 207 to prevent the inflow of sand or other particles into the slotted (or perforated) pipe 205 and the production tubing 130.

In addition to the sand control devices 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

Concerning the packer assemblies themselves, each packer assembly 210', 210" contains at least two packers. These represent an upper packer 212 and a lower packer 214. Each packer 212, 214 has an expandable portion or element fabricated from an elastomeric or a thermoplastic material capable of providing at least a temporary fluid seal against the surrounding wellbore wall 201.

It is understood that the packer assemblies 210', 210" are merely illustrative; the operator may choose to use only a single packer. In either instance, it is preferred that the packer be able to withstand the pressures and loads associated with a gravel packing process. Typically, such pressures are from about 2,000 psi to 3,000 psi.

The upper 212 and lower 214 packer elements are set shortly before a gravel pack installation process. The packer elements 212, 214 are preferably set by mechanically shearing a shear pin and sliding a release sleeve along an inner mandrel. Upward movement of the shifting tool (not shown) allows the packers 212, 214 to be activated in sequence. The lower packer 214 is activated first, followed by the upper packer 212 as the shifting tool is pulled upward through the respective inner mandrels.

An intermediate swellable packer element 216 may also optionally be provided in the packer assemblies 210', 210". The swellable packer element 216 assists in long term sealing. The swellable packer element 216 may be bonded to the outer surface of the mandrel 211. The swellable packer element 216 is allowed to expand over time when contacted by hydrocarbon fluids, formation water, or any chemical which may be used as an actuating fluid. As the packer element 216 expands, it forms a fluid seal with the surrounding zone, e.g., interval 114. In one aspect, a sealing surface of the swellable packet element 216 is from about 5 feet (1.5 meters) to 50 feet (15.2 meters) in length; and more preferably, about 3 feet (0.9 meters) to 40 feet (12.2 meters) in length.

The use of a packer (or optionally, a multi-packer assembly) in a gravel-packing completion helps to control and manage fluids produced from different zones. In this respect, a packer allows the operator to seal off an interval from either production or injection, depending on well function.

Figure 3A:
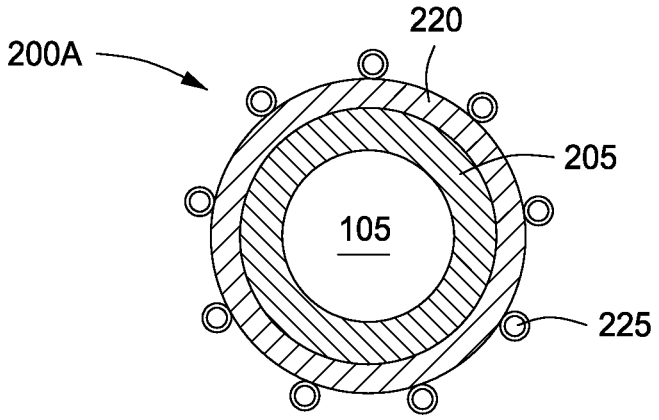
FIG. 3A provides a cross-sectional view of a sand control device, in one embodiment. Shunt tubes are seen outside of a sand screen to provide an alternative flowpath for a particulate slurry.
Figure 3B:
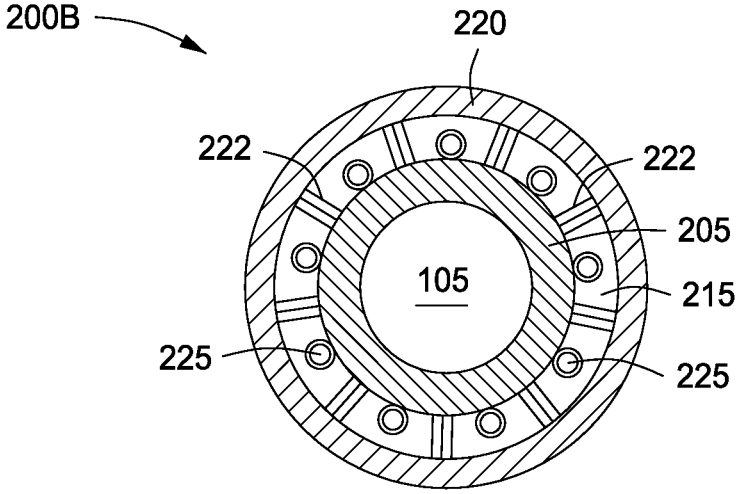
FIG. 3B provides a cross-sectional view of a sand control device, in an alternate embodiment. Shunt tubes are seen internal to a sand screen to provide an alternative flowpath for a particulate slurry.

The packers will incorporate alternate flow channels to bypass gravel slurry during a gravel packing operation. In addition, the sand control devices 200 will have alternate flow channels. FIGS. 3A and 3B provide cross-sectional views of sand screens with alternate flow channels, in different embodiments.

First, FIG. 3A provides a cross-sectional view of a sand control device 200A, in one embodiment. In FIG. 3A, a slotted (or perforated) base pipe 205 is seen. This is in accordance with base pipe 205 of FIGS. 1 and 2. The central bore 105 is shown within the base pipe 205 for receiving production fluids during production operations.

An outer mesh 220 is disposed immediately around the slotted or perforated base pipe 205. The outer mesh 220 preferably comprises a wire mesh or wires helically wrapped around the base pipe 205, and serves as a screen. In addition, shunt tubes 225 are placed radially and equidistantly around the outer mesh 220. This means that the sand control device 200A provides an external embodiment for the shunt tubes 225. The shunt tubes serve as alternate flow channels for delivering gravel slurry past any annular zone isolation or premature sand bridges which might form.

The configuration of the sand control device 200A may be modified. In this respect, the shunt tubes 225 may be moved internal to the screen 220.

FIG. 3B provides a cross-sectional view of a sand control device 200B, in an alternate embodiment. In FIG. 3B, the slotted (or perforated) base pipe 205 is again seen. This is in accordance with base pipe 205 of FIGS. 1 and 2. The central bore 105 is shown within the base pipe 205 for receiving production fluids during production operations.

Shunt tubes 225 are placed radially and equidistantly around the base pipe 205. The shunt tubes 225 reside immediately around the base pipe 230, and within a surrounding screen 220. This means that the sand control device 200B provides an internal embodiment for the shunt tubes 225.

An annular region 215 is created between the base pipe 205 and the surrounding outer mesh or screen 220. The annular region 215 accommodates the inflow of production fluids in a wellbore. The outer mesh 220 is supported by a plurality of radially extending support ribs 222. The ribs 222 extend through the annular region 215.

Figure 4A:
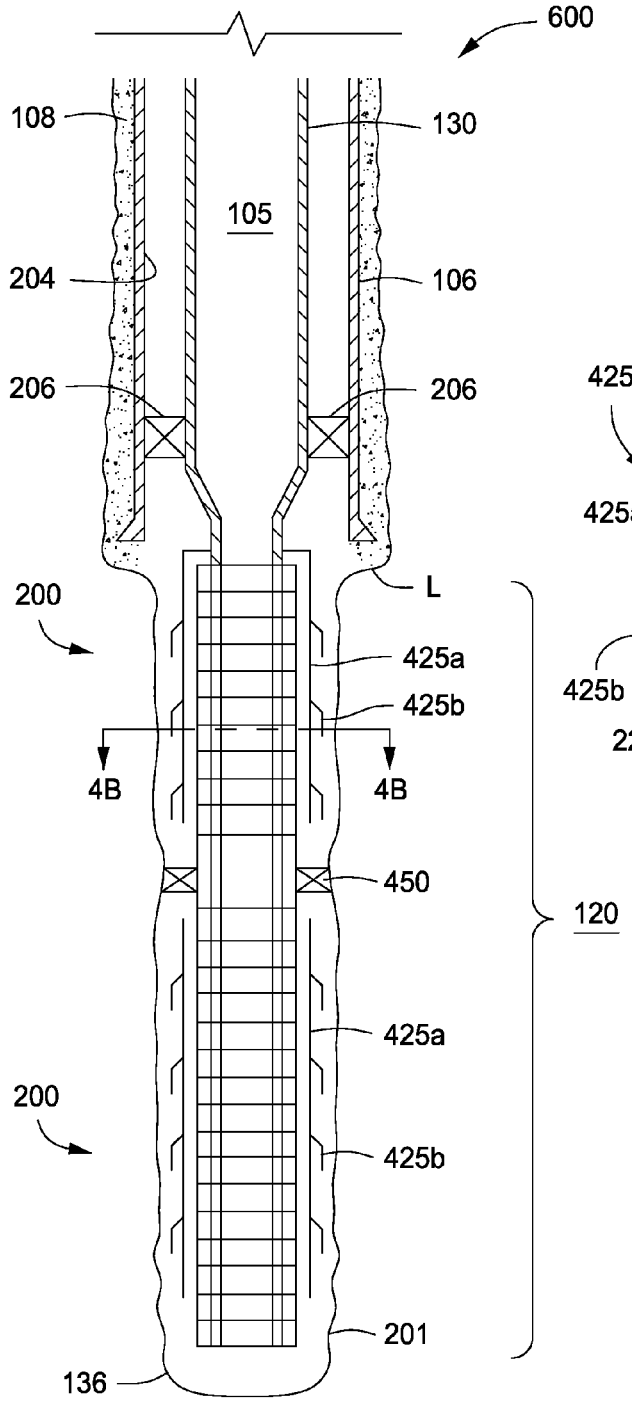
FIG. 4A is a cross-sectional view of a wellbore having a jointed sand control device therein. Transport tubes extend along the sand screen.

FIG. 4A presents a cross-sectional side view of a wellbore 400. The wellbore 400 is generally in accordance with wellbore 100. FIG. 4A shows primarily the lower portion of the wellbore 400, which has been completed as an open-hole. The open-hole portion extends down to the lower end 136.

Sand control devices 200 have been set along the lower portion 120 of the wellbore 400. The sand control devices 200 are jointed together. In addition, a single packer 450 is provided along the sand control devices 200. The packer 450 has been set against the surrounding wellbore wall 201.

Figure 4B:
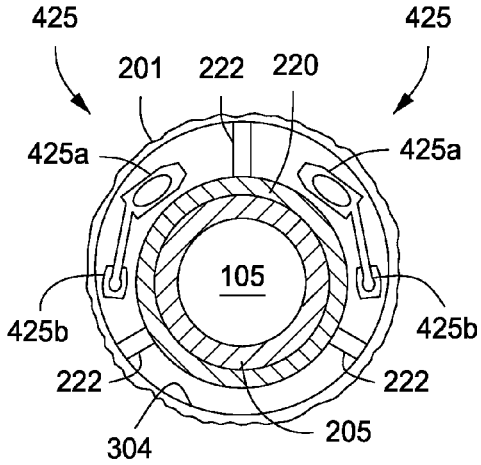
FIG. 4B is a cross-sectional view of one of the sand control devices of FIG. 4A, taken across line 4B-4B of FIG. 4A. Transport tubes and packing tubes are seen external to a sand screen.

FIG. 4B is a cross-sectional view of one of the sand control devices 200 of FIG. 4A, taken across line 4B-4B. In this view, a slotted or perforated base pipe 205 for the sand control device 200 is seen. The base pipe 205 defines a central bore 105 through which production fluids may flow. A sand screen 220 is disposed immediately around the base pipe 205. The sand screen 220 may include multiple wire segments, mesh screen, wire wrapping, or other filtering medium to prevent a predetermined particle size.

The wellbore 400 has not yet undergone gravel packing. In order to transport gravel slurry in a gravel packing operation, shunt tubes 425 are provided along each of the sand screens 220. In this embodiment, the shunt tubes 425 represent a combination of transport tubes 425*a* and packing tubes 425*b*. The transport tubes 425*a* transport slurry down the annulus between the sand screens 220 and the wellbore wall 201, while the packing tubes 425*b* serve as arteries to deliver slurry into the annulus for gravel packing.

It is understood that the communication module and methods herein are not confined by the particular design and arrangement of sand screens 200 and shunt tubes 425 unless specifically indicated by the claims. Further information concerning the use of external shunt tubes is found in U.S. Pat. No. 4,945,991 and U.S. Pat. No. 5,113,935. Further information on internal shunt tubes is found at U.S. Pat. No. 5,515,915 and U.S. Pat. No. 6,227,303.

The control of downhole equipment has historically been accomplished through mechanical manipulation using a working string. Alternatively, downhole equipment has been actuated through the application of hydraulic pressure, or through a hydraulic or electrical control line that runs from the surface. However, it is difficult to utilize these traditional means when a gravel pack is in place. Therefore, it is desirable to have an autonomous tool that resides along an open-hole portion or other completion interval of a wellbore that can activate downhole equipment. Further, it is desirable to employ a communications module within a wellbore that accommodates alternate flow channels for a gravel packing operation, and that can activate downhole equipment without the need for control lines and cables that are run from the surface down to the sand screens.

Figure 5A:
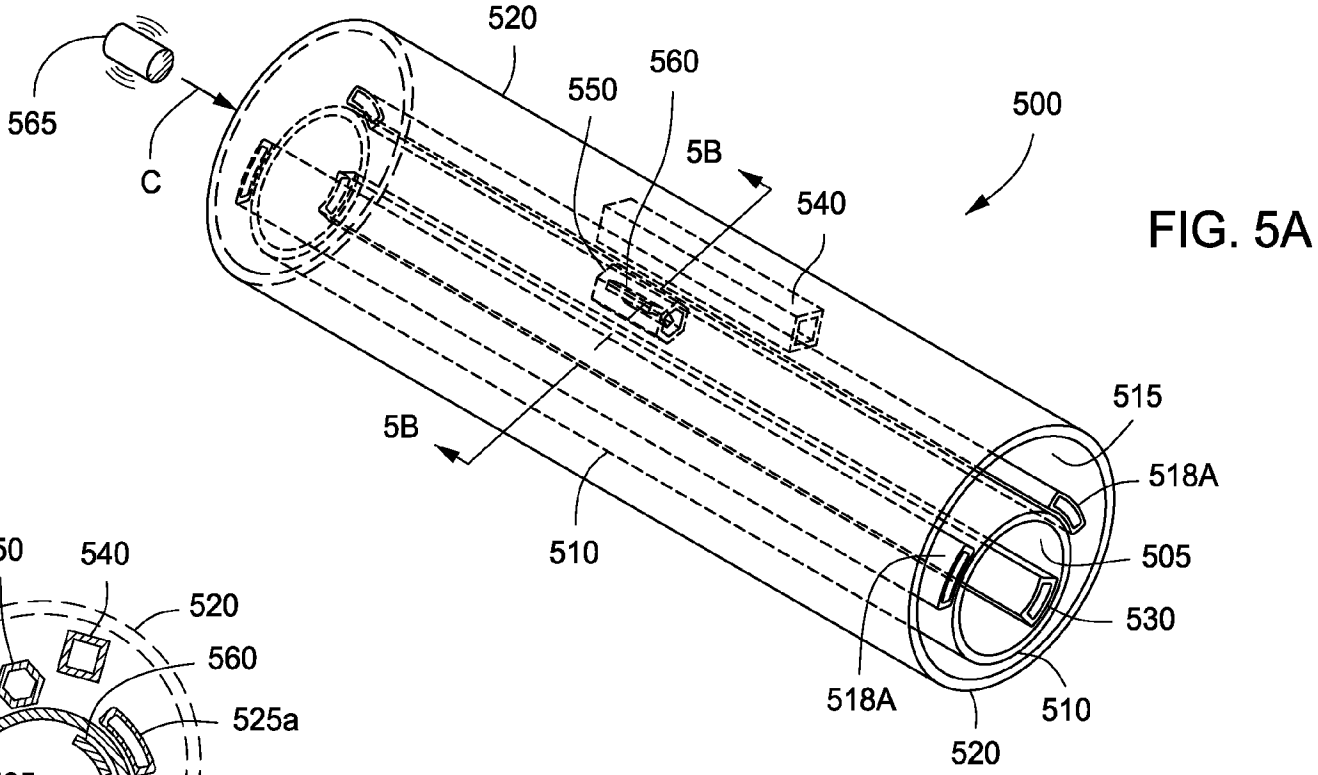
FIG. 5A is a perspective view of a communications module in accordance with the present inventions, in one embodiment. The communications module has a pre-programmed electrical circuit and a communication device for transmitting or receiving commands from a downhole carrier.

FIG. 5A is a perspective view of a communications module 500 in accordance with the present inventions, in one embodiment. The communications module 500 first has an inner mandrel 510. The inner mandrel 510 defines a bore 505 therein. Production fluids flow through the bore 505 en route to the surface 101.

The inner mandrel 510 has an inner diameter. The inner diameter is configured to generally match the inner diameter of the slotted or perforated base pipe of a sand screen, such as any of sand screens 200. The inner mandrel 510 of the communications module 500 threadedly connects to the base pipe of a joint of sand screen 200. In this way, fluid communication is provided between the inner mandrel 510 and the base pipe.

The communications module 500 also has an outer shroud 520. The outer shroud 520 is preferably fabricated from a metal screening material. The screening material does not function as a filtering medium, but simply protects components associated with the communications module 500.

The outer shroud 520 defines an inner bore 515. In the illustrative arrangement of FIG. 5A, the bore 515 of the outer shroud 520 is eccentric to the bore 505 of the inner mandrel 510. In this way, alternate flow channels can be accommodated. In the view of FIG. 5A, two transport tubes 525*a* are seen as the alternate flow channels.

Figure 5B:
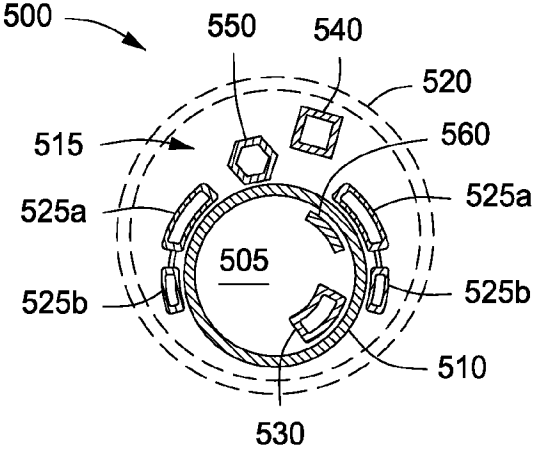
FIG. 5B is a cross-sectional view of the communications module of FIG. 5A, taken across line 5B-5B. An optional motor and associated control line are shown, along with transport tubes and packing tubes for transporting gravel slurry.

FIG. 5B is a cross-sectional view of the communications module 500 of FIG. 5A. The view is taken across line 5B-5B of FIG. 5A. In this view, the two transport tubes 525*a* are visible. In addition, two packing tubes 525*b* are seen. The packing tubes 525*b* receive slurry from the transport tubes 525*a* during a gravel packing operation, and then deliver the slurry into the annulus within the wellbore through a plurality of openings along the packing tube 525*b*.

When connecting the communications module 500 with a sand control device 200, the transport tubes will be aligned. Thus, transport tubes 525*a* of FIG. 5A will line up with the transport tubes 425*a* of FIG. 4A for slurry delivery. Of course, it is understood that other arrangements for alternate flow channels may be employed. In this respect, the alternate flow channels may be either an external shunt application (such as shown in FIG. 3A) or an internal shunt application (such as shown in FIG. 3B).

The communications module 500 also has a communications line 530. In the arrangement of FIGS. 5A and 5B, the communications line 530 runs along and within the bore 505 of the inner mandrel 510. However, the communications line 530 may optionally be disposed external to the inner mandrel 510.

The communications line 530 may carry hydraulic fluid such as water or a light oil. In that instance, the communications line 530 serves as a hydraulic control line. Alternatively, the communications line 530 may have one or more electrically conductive lines, or fiber optic cables. In these instances, the communications line 530 may be considered as an electrical control line. In either embodiment, the communications line 530 operates to actuate a downhole tool (not shown in FIG. 5A) by either delivering fluid or an electrical signal as a command.

The downhole tool may be, for example, a packer. Alternatively, the downhole tool may be a sliding sleeve along a mandrel or production tubing. Alternatively still, the downhole tool may be a valve or other inflow control device.

In order to deliver fluid or a signal to the downhole tool, the communications module 500 includes a pre-programmed electrical circuit. Such a circuit is shown schematically at 540 in both of FIGS. 5A and 5B. The pre-programmed electrical circuit 540 may be designed to send a signal that actuates a hydraulic motor in response to receiving an actuation signal. An illustrative hydraulic motor is seen at 550. Alternatively, the pre-programmed electrical circuit 540 may be designed to send an electrical signal (including, for example, a fiber optic light signal) in response to receiving an actuation signal. In one aspect, the pre-programmed electrical circuit 540 is further programmed to send the signal following a predetermined period of time, or in response to sensing a certain condition such as a downhole temperature, pressure, or strain.

The communications module 500 also includes a transmitter-receiver. An illustrative transmitter-receiver is shown at 560. The illustrative transmitter-receiver 560 is a transceiver, meaning that the device 560 incorporates both a transmitter and a receiver which share a common circuitry and housing. The transmitter-receiver receives a signal provided through a downhole carrier 565, and then sends its own signal to the pre-programmed electrical circuit 540.

The downhole carrier 565 is designed to send a signal to the transmitter-receiver 560. Thus, at a designated time, the operator may drop the downhole carrier 565 into the wellbore, and then pump it downhole. The downhole carrier 565 is shown in FIG. 5A moving into the inner mandrel 510 in the direction indicated by Arrow "C." The downhole carrier 565 will ultimately pass through the bore 505 of the communications module 500. There, the communications module 500 will be wirelessly sensed by the transmitter-receiver 560. The transmitter-receiver 560, in turn, will send a wired or wireless signal to the pre-programmed electrical circuit 540.

The transmitter-receiver 560 may be tuned to send different signals in response to signals that it receives from downhole carriers 565 having different frequencies. Thus, for example, if the operator wishes to slide a sleeve, it may drop a first downhole carrier 565 emitting a signal at a first frequency, which prompts the transmitter-receiver 560 to send a first signal to the pre-programmed electrical circuit 540 at its own first frequency, which then actuates the sleeve through the appropriate hydraulic or electrical command. Later, the operator may wish to re-operate the sleeve again or set an annular packer. The operator then drops a second downhole carrier 565 emitting a signal at a second frequency, which prompts the transmitter-receiver 560 to send a second signal to the pre-programmed electrical circuit 540 at its own second frequency, which then actuates the packer or the sleeve through the appropriate hydraulic or electrical command.

Figure 6:
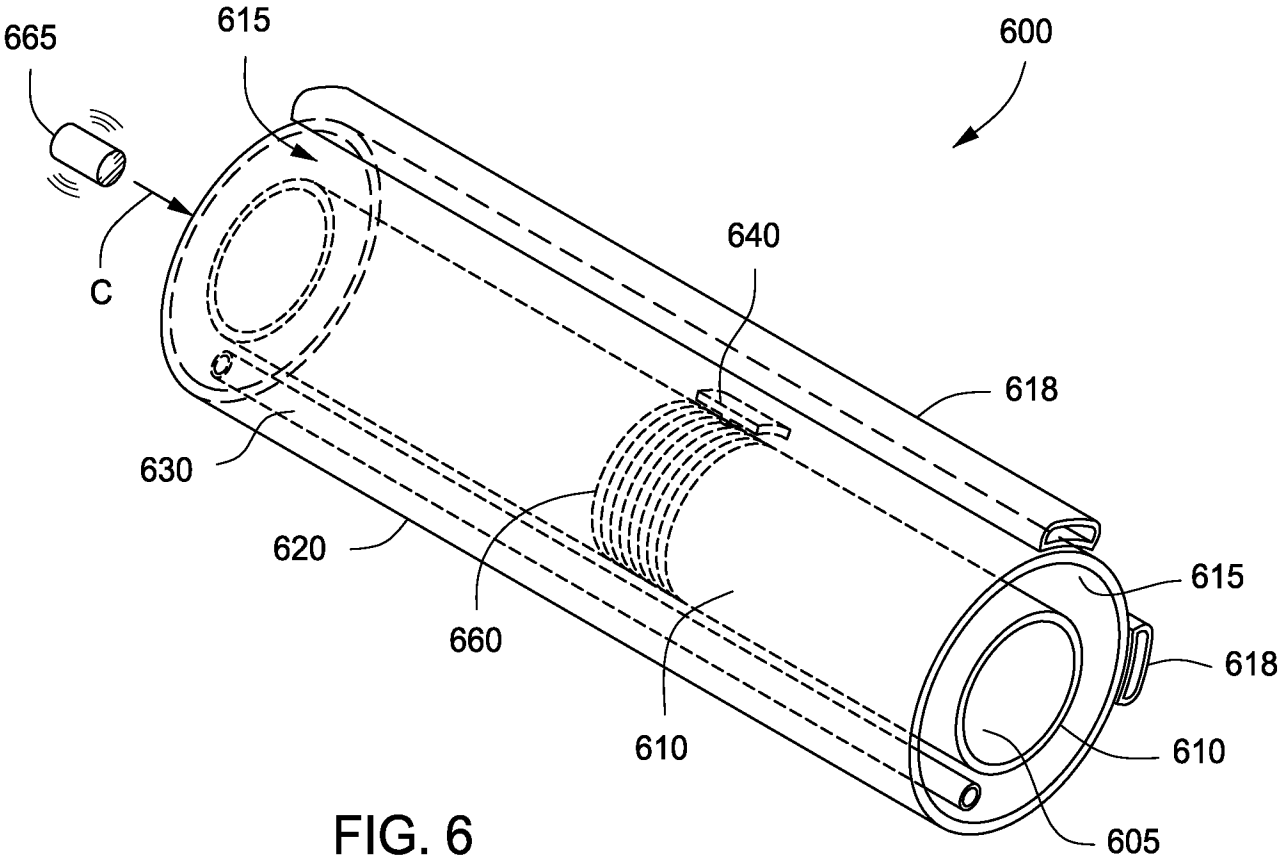
FIG. 6 is a perspective view of a communications module, in an alternate embodiment. Here, the communications module employs radio-frequency identification tags. The pre-programmed electrical circuit is an RFID circuit, and the communication device is an RFID antennae that communicates with an RFID tag.

In one preferred embodiment, the communications module operates through radio-frequency identification technology, or RFID. FIG. 6 is a perspective view of a communications module 600, in an alternate embodiment, wherein the communications module 600 employs RFID components.

The communications module 600 of FIG. 6 includes an inner mandrel 610. The inner mandrel 610 defines a bore 605 therein. Production fluids flow through the bore 605 en route to the surface 101.

The inner mandrel 610 has an inner diameter. The inner diameter is configured to generally match the inner diameter of a base pipe 205 of a sand screen, such as any of sand screens 200. The inner mandrel 610 of the communications module 600 threadedly connects to the base pipe of a joint of sand screen 200. In this way, fluid communication is provided between the inner mandrel 610 and the base pipe (such as the perforated base pipe 205 seen in FIG. 2 and FIG. 4B).

The communications module 600 also has an outer shroud 620. The outer shroud 620 is preferably fabricated from a metal screening material. The screening material does not function as a filtering medium, but simply protects components within the communications module 600.

The outer shroud 620 defines an inner bore 615. The bore 615 of the outer shroud 620 is substantially concentric to the bore 605 of the inner mandrel 610. In this way, external alternate flow channels can be accommodated. In the view of FIG. 6A, two transport tubes 618 are partially seen as the alternate flow channels.

The communications module 600 also has a communications line 630. In the illustrative arrangement of FIG. 6, the communications line 630 runs along and within the bore 615 of the outer shroud 620. Thus, the communications line 630 is placed outside of the inner mandrel 610. It is understood that the communications line 630 may optionally be disposed internal to the inner mandrel 610.

The communications line 630 functions in the same way as communications line 530 of FIGS. 5A and 5B. In this respect, the communications line 630 may carry hydraulic fluid such as water or a light oil. In that instance, the communications line 630 serves as a hydraulic control line. Alternatively, the communications line 630 may have one or more electrically conductive lines, or fiber optic cables. In these instances, the communications line 630 may be considered as an electrical control line. In either embodiment, the communications line 630 conveys an actuating signal to downhole tool by either delivering fluid under pressure or by delivering an electrical command signal.

In order to deliver fluid or a signal to the downhole tool, the communications module 600 includes an RFID circuit. Such a circuit is shown somewhat schematically at 640. The RFID circuit 640 may be designed to send a signal that actuates a hydraulic motor in response to receiving an actuation signal. This causes the motor to pump fluid through the control line 630 under pressure. Alternatively, the RFID circuit 640 may be designed to send an electrical signal (including, for example, a fiber optic light signal) in response to receiving an actuation signal.

The communications module 600 also includes a transmitter-receiver. In this embodiment, the transmitter-receiver is an RF antenna. An illustrative RF antenna is shown at 660. The illustrative antennae 660 is a coil wrapped around or within the base pipe 610. The base pipe 610 is fabricated from a non-metallic material such as ceramic or plastic to accommodate the metallic coil. The RF antenna 660 receives a signal provided through a downhole carrier 665, and then sends its own signal to the pre-programmed RFID circuit 640.

In the RFID embodiment of FIG. 6, the downhole carrier 665 is a radio-frequency ("RFID") tag. The RFID tag 665 is designed to send a signal to the RF antenna 660. Generally, the RFID tag 665 consists of an integrated circuit that stores, processes and transmits the RF signal to the receiving antenna 660.

At a designated time, the operator may drop an RFID tag 665 into the wellbore, and then pump it or otherwise allow it to drop from the surface downhole. The tag 665 is shown in FIG. 6 moving into the inner mandrel 610 in the direction indicated by Arrow "C." The tag 665 will ultimately pass through the bore 605 of the communications module 600. There, the RFID tag 665 will be wirelessly sensed by the RF antenna 660. The RF antenna 660, in turn, will send a wired or wireless signal to the pre-programmed RFID circuit 640.

The communications module 600 (or RFID module) may have other components. For example, the module 600 may include the hydraulic motor 550 of FIG. 5A. The module 600 may also include devices for sensing conditions downhole such as pressure gauges, temperature gauges, strain gauges, flow meters, in-line tracer analyzers, and sand detectors. The RFID circuit 640 may actuate a downhole device such as a sliding sleeve or a packer or a valve in response to readings made by such sensing devices.

The communications module 600 will also have a battery (not shown). The battery provides power for the RFID circuit. The battery may also provide power to the sensing equipment and any hydraulic motor.

It is also noted that the flow of information could be reversed. In this respect, information sensed by sensing equipment and sent to the RFID circuit 640 may be sent to the RF antenna 660, and then communicated to the RFID tag 665. The tag 665 is then pumped back to the surface 101 and retrieved. Information received and carried by the tag 665 is downloaded and analyzed.

In yet another embodiment, the transmitter-receiver that is used in a communications module is an acoustic transponder. In this arrangement, the transmitter-receiver may receive acoustic signals and, upon detecting a predetermined acoustic frequency, send an electrical signal.

Based upon the downhole tools described above, novel methods for completing an open-hole (or other) wellbore may be provided herein. The methods may utilize the above described communications module in various embodiments for completing a wellbore (method 700), for actuating a downhole tool (method 800) or for monitoring wellbore conditions (method 800) (all described below), or all three.

Figure 7:
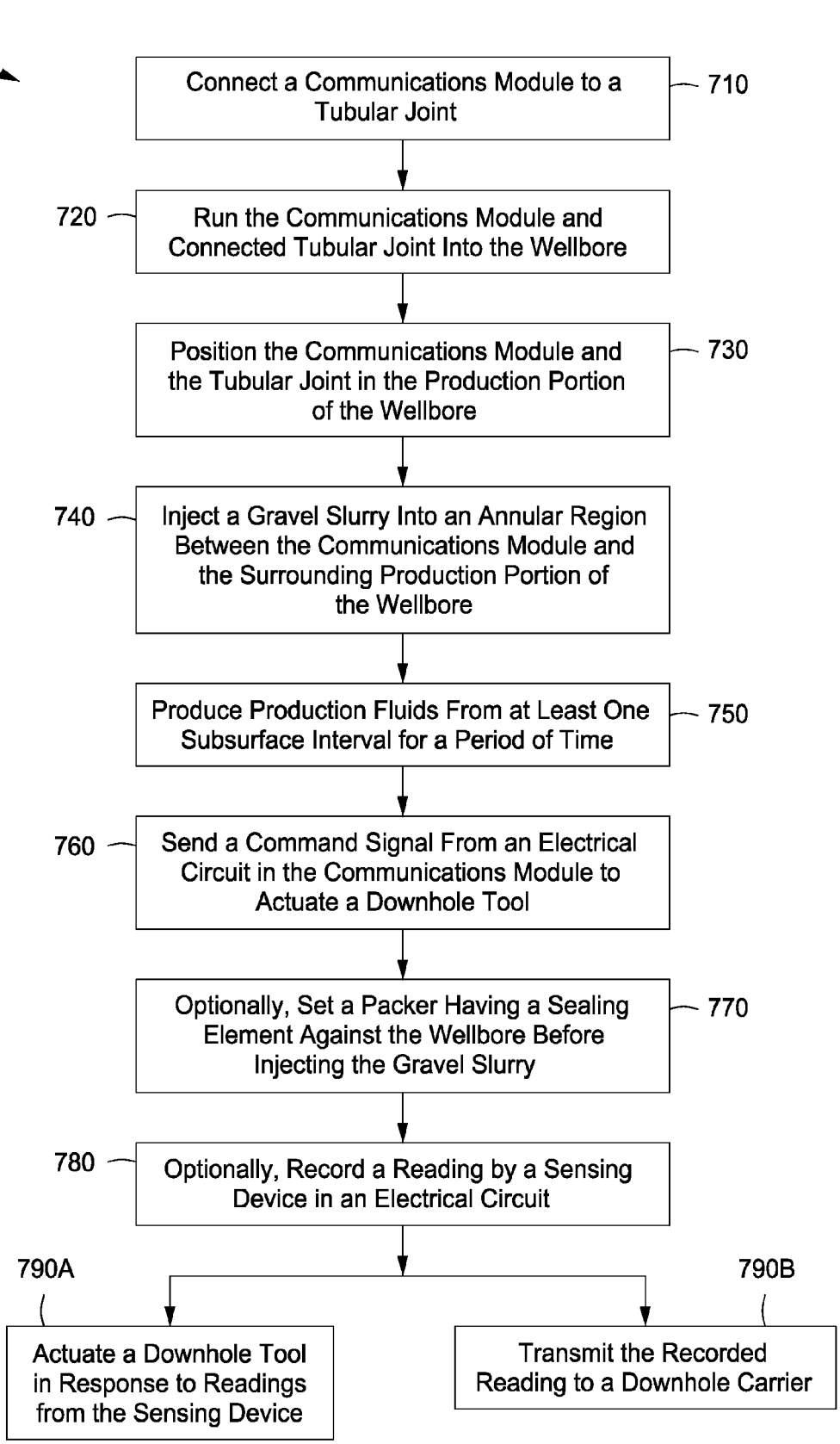
FIG. 7 is a flowchart that provides steps that may be used, in one embodiment, for completing a wellbore. The wellbore has a lower end defining an open-hole portion. The method uses a communications module having alternate flow channels.

FIG. 7 provides a method 700 for completing a wellbore. The wellbore has a lower end defining a completion interval. The completion interval may be either a cased hole portion or an open-hole portion.

The method 700 first includes connecting a communications module to a tubular joint. This is seen at Box 710. The communications module may be in accordance with any of the communications modules described above. The module will at least include alternate flow channels configured to permit a gravel slurry to partially bypass the communications module during a gravel packing procedure.

The module will also have a control line. The control line is configured to reside entirely within the open-hole portion of the wellbore. The control line conveys an actuating command signal to a downhole tool within the wellbore.

The method 700 will also include running the communications module and the connected tubular joint into the wellbore. This is provided at Box 720. The tubular joint may comprise a joint of a sand control device. The sand control device will have a sand screen and alternate flow channels. Alternatively, the tubular joint may be a packer that can be set within the completion interval before a gravel packing operation begins. Such a packer will also have alternate flow channels so that gravel may be packed in the annulus below the packer.

The method 700 also includes positioning the communications module and the tubular joint in the producing portion of the wellbore. This is seen at Box 730. The producing portion may be an open-hole portion, or a portion of a cased wellbore that is perforated. Thereafter, the method includes injecting a gravel slurry into an annular region formed between the communications module and the surrounding wellbore. This is shown at Box 740. The gravel slurry also travels through the at least one alternate flow channel to allow the gravel slurry to partially bypass the communications module. In this way, the completions interval is gravel-packed below the communications module.

Preferably, the wellbore is completed for the production of hydrocarbon fluids. The method 700 further includes producing production fluids from the completion interval. The producing step is provided at Box 750. In one aspect, the completion interval may be at least one subsurface interval of an open-hole portion in the wellbore.

In one embodiment, the control line contains an electrical line. In this instance, the method 700 may further comprise sending a command signal from the electrical circuit through the electrical line to actuate the downhole tool. This is seen at Box 760. The downhole tool may be, for example, a sliding sleeve, a valve, or a packer.

The method 700 operates in conjunction with a downhole carrier. The downhole carrier is essentially an information tag that is pumped, dropped, or otherwise released into the wellbore. Information may flow from the downhole carrier to the transmitter-receiver, or from the transmitter-receiver to the downhole carrier. In the first aspect, the transmitter-receiver is programmed to (i) receive a signal from the downhole carrier and, (ii) in response to the received signal, send a separate instruction signal to the programmed electrical circuit to actuate the downhole tool. In the second aspect, the transmitter-receiver receives information from the electrical circuit and sends it to the downhole carrier. In either event, the information is beneficially exchanged within the wellbore during wellbore operations without need of an electric line or a working string.

The method 700 also optionally includes setting a packer in the producing portion of the wellbore. This is provided at Box 770. The packer has a sealing element to provide a seal of the annulus between the sand control device and the surrounding formation. This enables the isolation of a selected interval. The packer is preferably set before the step of injecting a gravel slurry in Box 740.

The communications module may also include a sensing device. The sensing device may be, for example, a pressure gauge, a flow meter, a temperature gauge, a strain gauge, a sand detector, or an in-line tracer analyzer. The sensing device is in electrical communication with the electrical circuit. In this instance, the method 700 further includes recording a reading by the sensing device in the electrical circuit. This is provided at Box 780.

The electrical circuit may send a signal from the electrical circuit to the control line to actuate the downhole tool in response to a selected reading by the sensing device. This is shown at Box 790A. Alternatively, the electrical circuit may send its signal to the transmitter-receiver, which in turn transmits a wireless signal containing the recorded readings to the downhole carrier. This is shown at Box 790B.

A more detailed progression of steps for Box 790B is as follows:

record a reading by the sensing device in the electrical circuit;

send a signal from the electrical circuit to the transmitter-receiver conveying the recorded readings;

receive the signal with the recorded readings from the electrical circuit at the transmitter-receiver;

wirelessly transmit the recorded readings from the transmitter-receiver to the downhole carrier; and deliver the downhole carrier to a surface for data analysis.

Figure 8:
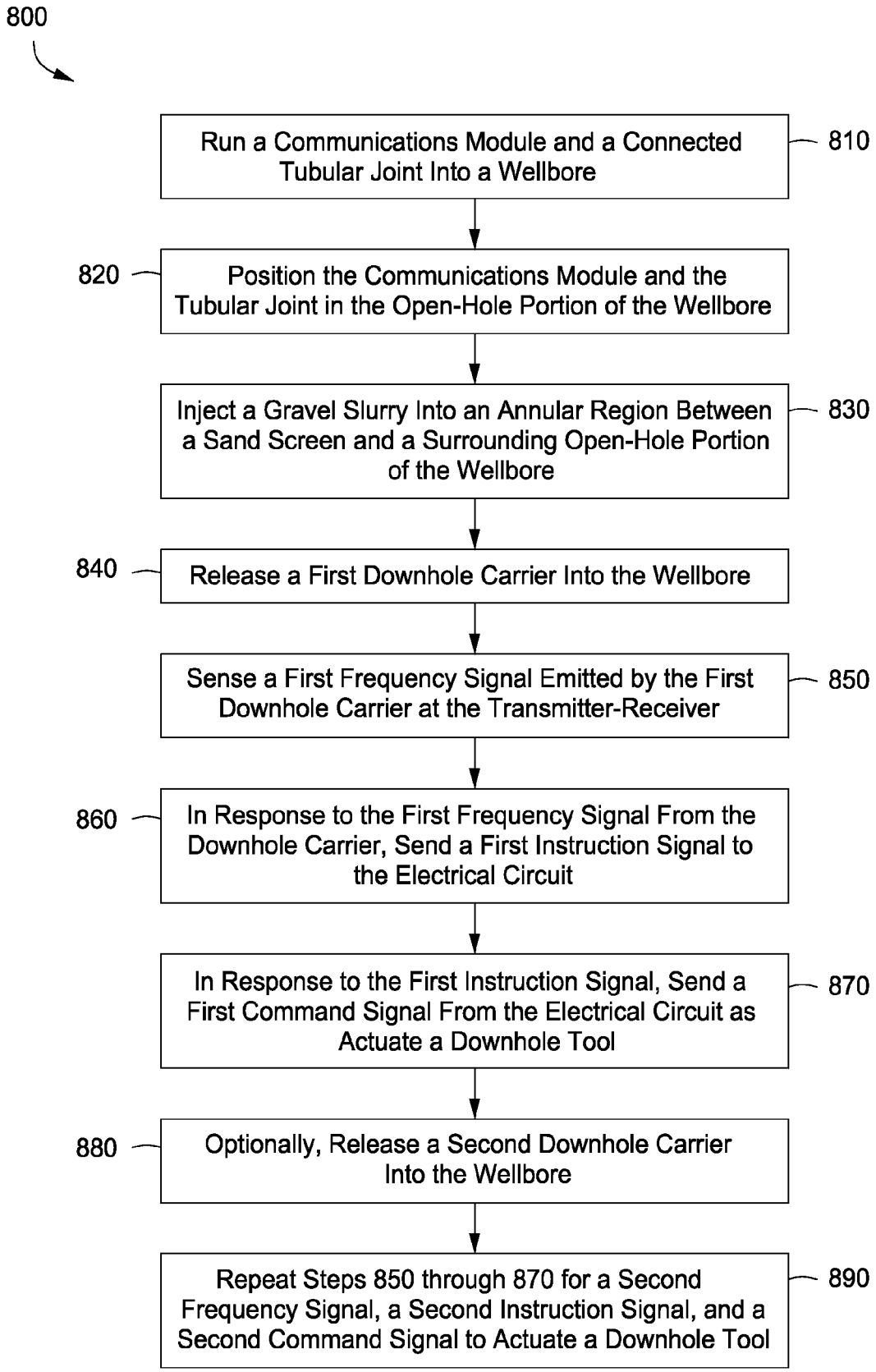
FIG. 8 is a flowchart that provides steps that may be used, in one embodiment, for actuating a downhole tool in a wellbore. The wellbore has a lower end defining an open-hole portion.

A separate method for actuating a downhole tool is also provided herein. FIG. 8 is a flow chart showing steps for a method 800 for actuating a downhole tool in a wellbore, in one embodiment. The wellbore again has a lower end defining a completion interval. The completion interval is preferably an open-hole portion.

In one embodiment, the method 800 includes running a communications module and a connected tubular joint into the wellbore. This is seen at Box 810. The communications module may be in accordance with the communications module described above. The module will at least include alternate flow channels configured to permit a gravel slurry to bypass the communications module during a gravel packing procedure. The module will also have a control line configured to reside entirely within the open-hole portion of the wellbore. The control line conveys an actuating command signal to a downhole tool within the wellbore.

The method 800 also includes positioning the communications module and the tubular joint in the open-hole portion of the wellbore. Preferably, the tubular joint is part of a sand control device. The sand control device will have a filtering screen, and will also have at least one alternate flow channel. The method 800 will then further include injecting a gravel slurry into an annular region formed between the sand control device and the surrounding open-hole portion of the wellbore. This is seen at Box 830. The sand control device will also have at least one alternate flow channel to allow the gravel slurry to at least partially bypass the joint of the sand control device during the gravel packing operation.

After the communications module and the tubular joint are positioned, the method 800 includes releasing a first downhole carrier into the wellbore. This is provided at Box 840. The downhole carrier is essentially an information tag that is pumped, dropped, or otherwise released into the wellbore. In this arrangement, the downhole carrier emits a first frequency signal. Thus, information flows from the downhole carrier to the transmitter-receiver within the wellbore. This may take place during wellbore operations without need of an electric line or a working string extending from the surface.

The method 800 also includes sensing the first frequency signal at the transmitter-receiver. This is shown at Box 850. In response to the first frequency signal, a first instruction signal is sent from the transmitter-receiver to the electrical circuit. This is indicated at Box 860.

The method 800 further includes sending a first command signal from the electrical circuit. This is done in response to the first instruction signal, and is for the purpose of actuating a downhole tool. The command signal step is provided at Box 870. Actuating the downhole tool may comprise, for example, (i) moving a sliding sleeve to close off production from a selected interval within the open-hole portion, (ii) moving a sliding sleeve to open up production from a selected interval within the open-hole portion, (iii) or setting a packer. The packer is preferably set before the step of injecting a gravel slurry in Box 830.

Preferably, the communications module employs RFID technology. In such an embodiment, the pre-programmed electrical circuit is an RFID circuit. Further, the downhole carrier is an RFID tag that emits a radio-frequency signal, while the transmitter-receiver is an RF antenna.

Alternatively, the communications module employs acoustic technology. In such an instance, the downhole carrier comprises an acoustic frequency generator. The transmitter-receiver then comprises an acoustic antenna that receives acoustic signals from the downhole carrier, and in response sends an electrical signal to the pre-programmed electrical circuit.

In one embodiment, the method 800 may utilize a second downhole carrier. In this instance, the method 800 includes releasing a second downhole carrier into the wellbore. This is provided at Box 880. The second downhole carrier emits a second frequency signal. The second frequency signal is sensed at the transmitter-receiver. In response to the second frequency signal, a second instruction signal is sent from the transmitter-receiver to the electrical circuit. Then, in response to the second instruction signal, a second command signal is sent from the electrical circuit to actuate a downhole tool. These additional steps are seen collectively in Box 890.

In connection with the method 800, it is preferred that the tubular joint connected to the inner mandrel is a joint of a sand control device. This joint will also have at least one alternate flow channel. The method 800 may then further include injecting a gravel slurry into an annular region formed between the sand control device and the surrounding wellbore. During the injection process, a portion of the gravel slurry travels through the at least one alternate flow channel to allow the gravel slurry to partially bypass the joint of the sand control device. In this way, the completions interval is gravel-packed below the communications module.

The present disclosure finally provides a method for monitoring conditions in a wellbore. The wellbore again has a lower end defining a completion interval. The completion interval is preferably an open-hole portion. Monitoring takes place during hydrocarbon production operations after a gravel packing operation has been conducted.

Figure 9:
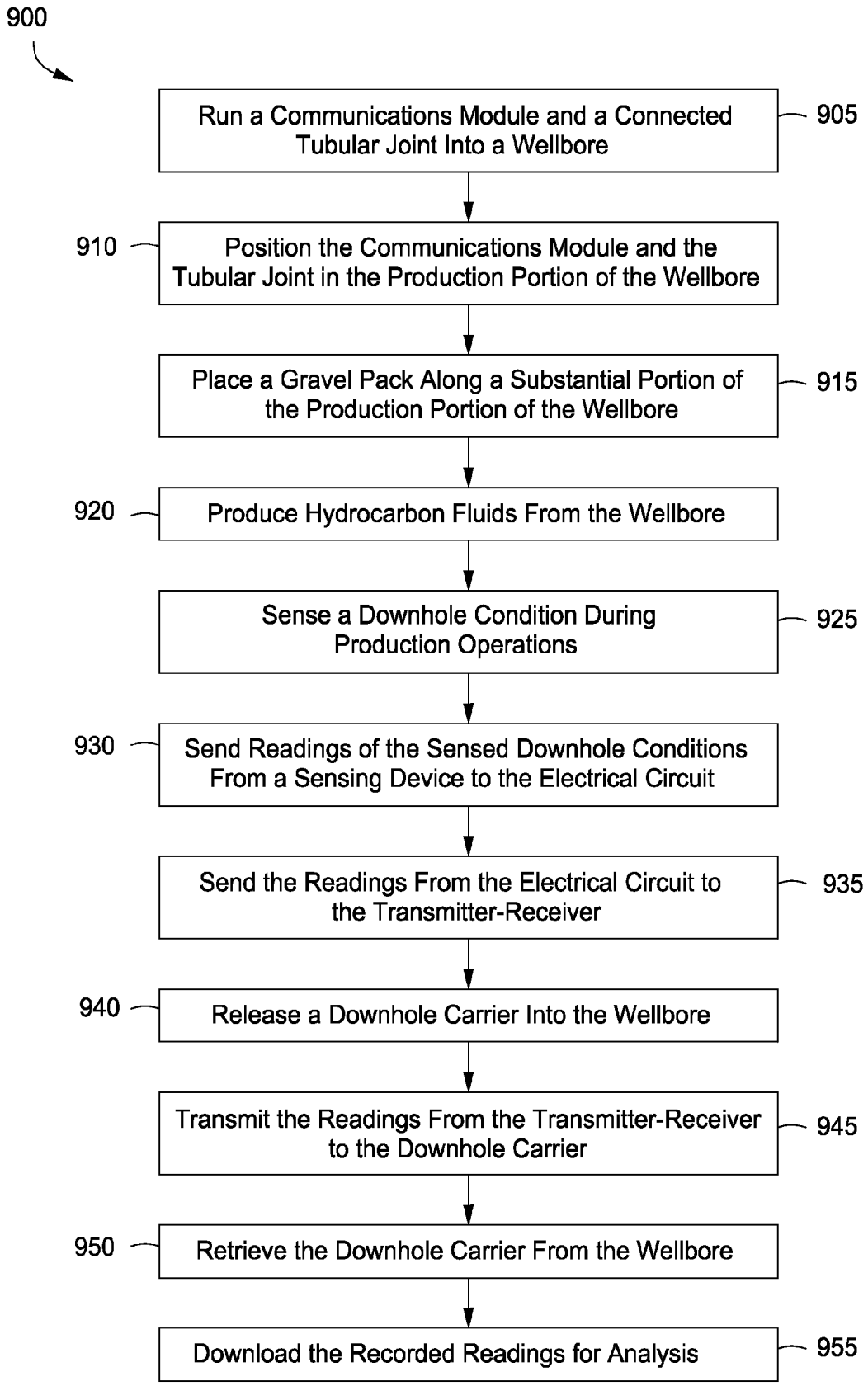
FIG. 9 is flowchart that provides steps for a method for monitoring conditions in a wellbore. The wellbore has a lower end defining an open-hole portion.

FIG. 9 provides a flow chart showing steps for a method 900 for monitoring wellbore conditions. In one embodiment, the method 900 includes running a communications module and a connected tubular joint into the wellbore. This is seen at Box 905. The communications module may be in accordance with the communications module described above. The module will at least include alternate flow channels configured to permit the gravel slurry to partially bypass the communications module during a gravel packing procedure. The module will also have a control line configured to reside entirely within the open-hole portion (or other completion interval) of the wellbore. The control line conveys an actuating command signal to a downhole tool within the wellbore. Further, the module will have an inner mandrel defining a bore through which production fluids may flow.

In support of the monitoring method 900, the communications module will also have a sensing device. The sensing device may sense for temperature, pressure, flow rate, or other fluid or formation conditions. The sensing device is in electrical communication with a programmed electrical circuit. The electrical circuit may record readings taken by the sensing device.

The method 900 also includes positioning the communications module and the tubular joint in the producing portion of the wellbore. This is provided at Box 910. Preferably, the tubular joint is part of a sand control device. The sand control device will have a filtering screen, and will also have at least one alternate flow channel. The method 900 will then further include placing a gravel pack along a substantial portion of the producing portion of the wellbore. This is shown at Box 915.

The method 900 also includes producing hydrocarbon fluids from the wellbore. This is seen at Box 920. The method 900 also includes sensing a downhole condition. This is noted at Box 925. The sensing is done by the sensing device during production operations. Sensing takes place using a sensing device that is in electrical communication with an electrical circuit.

The method 900 further includes sending readings from the sensing device to the electrical circuit. This is provided at Box 930. From there, readings are sent from the electrical circuit to a transmitter-receiver. This is given at Box 935.

In the method 900, a downhole carrier is employed. Thus, the method 900 also includes releasing a downhole carrier into the wellbore. This is demonstrated at Box 940. The downhole carrier is preferably an RFID tag that emits or receives a radio-frequency signal. In this instance, the pre-programmed electrical circuit is an RFID circuit, and the transmitter-receiver is an RF antenna.

Different means may be employed for releasing the downhole carrier. The downhole carrier may be released from the surface. In this instance, the operator may pump the downhole carrier down into the wellbore, or it may sink gravitationally. Alternatively, releasing the downhole carrier comprises releasing the downhole carrier from a receptacle in the open-hole portion of the wellbore at or below the communications module. This latter arrangement may include the use of a separate information tag. Thus, the method may include pumping a tag from the surface into the wellbore, the tag emitting a first frequency signal, sensing the first frequency signal at the transmitter-receiver, and in response to sensing the first frequency signal, releasing the downhole carrier into the wellbore.

In either instance, the downhole carrier passes through the inner mandrel or otherwise comes into close proximity with the transmitter-receiver along the inner mandrel. The readings are then sent to the downhole carrier. Thus, the method 900 further includes the step of transmitting the readings from the transmitter-receiver to the downhole carrier. This is provided at Box 945. The transmitting step of Box 945 is done wirelessly.

It is desirable to obtain the readings at the surface for analysis. Since there is no electric or fiber optic line extended from the gravel pack to the surface, the downhole carrier must be retrieved. Therefore, the method 900 includes the step of retrieving the downhole carrier from the wellbore. This is indicated at Box 950. Then, the method 900 includes downloading the recorded readings for analysis. This is shown at Box 955.

While it will be apparent that the inventions herein described are well calculated to achieve the benefits and advantages set forth above, it will be appreciated that the inventions are susceptible to modification, variation and change without departing from the spirit thereof. Improved methods for completing a wellbore are provided so as to seal off one or more selected subsurface intervals. An improved communications module is also provided. The inventions permit an operator to control a downhole tool or monitor a downhole condition wirelessly.

What is claimed is:

1. A communications module for downhole operations along a completion interval of a wellbore, comprising:

an inner mandrel;

at least one alternate flow channel along the inner mandrel to provide a route for gravel slurry to partially bypass the communications module during a gravel packing operation and enable gravel packing below the communications module;

a transmitter-receiver for (i) receiving a signal, and (ii) in response to the received signal, sending a separate instruction signal;

an electrical circuit programmed to (i) receive a signal and, in response to the received signal, deliver an actuating command signal; and a control line configured to reside entirely within the completion interval of the wellbore, the control line conveying the actuating command signal provided by the electrical circuit;

wherein the communications module is configured to connect to a tubular joint in a wellbore.

2. The communications module of claim 1, wherein the at least one alternate flow channel comprises at least one transport tube or longitudinal bypass annulus.

3. The communications module of claim 1, wherein the completion interval represents an open-hole portion of the wellbore.

4. The communications module of claim 3, wherein:

the communications module further comprises an outer shroud circumferentially disposed about the inner mandrel, the outer shroud permitting the flow of fluids there through; and the at least one transport tube resides (i) in a bore of the outer shroud between the inner mandrel and the outer shroud, or (ii) outside of the outer shroud.

5. The communications module of claim 3, wherein the tubular joint comprises a joint of a sand control device.

6. The communications module of claim 3, wherein the tubular joint comprises a zonal isolation packer also having at least one alternate flow channel.

7. The communications module of claim 1, wherein:

the transmitter-receiver is pre-programmed to (i) receive a wireless signal emitted from a downhole carrier and, (ii) in response to the received signal, send a separate instruction signal to the electrical circuit to actuate a downhole tool.

8. The communications module of claim 7, wherein:

the pre-programmed electrical circuit is an RFID circuit;

the downhole carrier is an RFID tag that emits a radio-frequency signal; and the transmitter-receiver is an RF antenna.

9. The communications module of claim 7, wherein:

the downhole carrier comprises an acoustic frequency generator; and the transmitter-receiver comprises an acoustic antenna that receives acoustic signals from the downhole carrier, and in response sends the instruction signal to the pre-programmed electrical circuit to actuate the downhole tool.

10. The communications module of claim 7, wherein:

the control line contains a hydraulic fluid; and the communications module further comprises a hydraulic motor configured to provide pressure to the hydraulic fluid to actuate the downhole tool in response to the command signal from the pre-programmed electrical circuit.

11. The communications module of claim 7, wherein:

the control line contains an electrical line; and the electrical circuit is programmed to send an electrical command signal through the electrical line to actuate the downhole tool.

12. The communications module of claim 1, wherein the communications module further comprises a sensing device.

13. The communications module of claim 12, wherein:

the sensing device comprises a pressure gauge, a flow meter, a temperature gauge, a sand detector, a strain gauge, an in-line tracer analyzer, or combinations thereof; and the sensing device is in electrical communication with the electrical circuit.

14. The communications module of claim 13, wherein the electrical circuit is programmed to send a command signal to the control line to actuate a downhole tool in response to a selected reading by the sensing device.

15. The communications module of claim 13, wherein:

the electrical circuit receives and records readings from the sensing device;

the electrical circuit is programmed to send a signal to the transmitter-receiver conveying the recorded readings; and the transmitter-receiver is programmed to (i) receive the recorded readings from the electrical circuit and, (ii) in response to the received recorded readings, wirelessly transmit the recorded readings to a downhole carrier.

16. The communications module of claim 1, wherein the downhole tool comprises a sliding sleeve, a packer, a valve, or combinations thereof.

17. A method for completing a wellbore, the wellbore having a lower end defining a completion interval, and the method comprising:

connecting a communications module to a tubular joint, the communications module comprising:

at least one alternate flow channel configured to permit a gravel slurry to partially bypass the communications module during a gravel packing procedure, and a control line configured to reside entirely within the wellbore for conveying an actuating command signal to a downhole tool;

running the communications module and the connected tubular joint into the wellbore;

positioning the communications module and the tubular joint in the wellbore; and injecting a gravel slurry into an annular region formed between the communications module and the surrounding wellbore, while providing that a portion of the gravel slurry travels through the at least one alternate flow channel to allow the gravel slurry to partially bypass the communications module and provide gravel packing below the communications module.

18. The method of claim 17, wherein the communications module further comprises:

an inner mandrel; and an outer shroud circumferentially disposed about the inner mandrel, the outer shroud permitting the flow of fluids there through.

19. The method of claim 18, wherein:

the tubular joint comprises a joint of a sand control device also having at least one alternate flow channel;

the inner mandrel is dimensioned to connect to a base pipe of a sand control device; and injecting a gravel slurry further comprises injecting the slurry into an annular region formed between the sand control device and the surrounding wellbore, while providing that a portion of the gravel slurry travels through the at least one alternate flow channel to allow the gravel slurry to at least partially bypass the joint of the sand control device.

20. The method of claim 17, wherein the communications module further comprises:

a transmitter-receiver for (i) receiving a signal, and (ii) in response to the received signal, sending a separate instruction signal; and an electrical circuit programmed to (i) receive a signal and, in response to the received signal, deliver an actuating command signal.

21. The method of claim 20, wherein:

the completion interval defines one or more zones of interest along an open-hole portion of the wellbore;

the wellbore is completed for fluid production; and the method further comprises producing production fluids from at least one subsurface interval along the open-hole portion of the wellbore for a period of time.

22. The method of claim 20, wherein:

the transmitter-receiver is programmed to (i) receive a wireless signal from a downhole carrier and, (ii) in response to the received signal, send a separate instruction signal to the electrical circuit to actuate the downhole tool.

23. The method of claim 22, wherein:

the control line contains an electrical line; and the method further comprises sending a command signal from the electrical circuit through the electrical line to actuate the downhole tool.

24. The method of claim 19, wherein the communications module further comprises a sensing device.

25. The method of claim 24, wherein:

the sensing device comprises a pressure gauge, a flow meter, a temperature gauge, a sand detector, a strain gauge, an in-line tracer analyzer, or combinations thereof; and the sensing device is in electrical communication with the electrical circuit.

26. The method of claim 25, further comprising:

recording a reading by the sensing device in the electrical circuit; and sending a signal from the electrical circuit to the control line to actuate the downhole tool in response to a selected reading by the sensing device.

27. The communications module of claim 26, wherein:

the control line contains a hydraulic fluid;

the communications module further comprises a hydraulic motor; and sending a signal from the electrical circuit to the control line comprises sending a signal from the electrical circuit to the hydraulic motor to provide pressure to the hydraulic fluid, thereby actuating the downhole tool in response to the command signal from the electrical circuit.

28. The method of claim 27, further comprising:

recording a reading by the sensing device in the electrical circuit;

sending a signal from the electrical circuit to the transmitter-receiver conveying the recorded readings;

receiving the signal with the recorded readings from the electrical circuit at the transmitter-receiver;

wirelessly transmitting the recorded readings from the transmitter-receiver to the downhole carrier; and delivering the downhole carrier to a surface for data analysis.

29. The method of claim 17, wherein the downhole tool comprises a sliding sleeve or a packer, or a valve.

30. A method for actuating a downhole tool in a wellbore, the wellbore having a lower end defining a completion interval, and the method comprising:

running a communications module and a connected tubular joint into the wellbore, the communications module comprising:

a pre-programmed electrical circuit, a transmitter-receiver, at least one alternate flow channel configured to allow a gravel slurry to partially bypass the communications module during a gravel packing procedure and permit gravel packing below the communications module, and a control line configured to reside entirely within the wellbore for conveying an actuating signal to a downhole tool;

positioning the communications module and the tubular joint in the wellbore;

releasing a first downhole carrier into the wellbore, the downhole carrier emitting a first frequency signal;

wirelessly sensing the first frequency signal at the transmitter-receiver;

in response to the first frequency signal, sending a first instruction signal from the transmitter-receiver to the electrical circuit; and in response to the first instruction signal, sending a first command signal from the electrical circuit to actuate a downhole tool.

31. The method of claim 30, wherein the communications module further comprises:

an inner mandrel; and an outer shroud circumferentially disposed about the inner mandrel, the outer shroud permitting the flow of fluids there through.

32. The method of claim 30, wherein:

the pre-programmed electrical circuit is an RFID circuit;

the downhole carrier is an RFID tag that emits a radio-frequency signal; and the transmitter-receiver is an RF antenna.

33. The method of claim 30, wherein:

the downhole carrier comprises an acoustic frequency generator; and the transmitter-receiver comprises an acoustic antenna that receives acoustic signals from the downhole carrier, and in response sends an electrical signal to the pre-programmed electrical circuit.

34. The method of claim 30, wherein:

the control line contains a hydraulic fluid; and the communications module further comprises a hydraulic motor configured to provide pressure to the hydraulic fluid to actuate the downhole tool in response to the first command signal from the pre-programmed electrical circuit.

35. The method of claim 30, wherein:

the control line contains an electrical line; and sending a first command signal from the electrical circuit to actuate the downhole tool comprises sending an electrical command signal through the electrical line to actuate the downhole tool.

36. The method of claim 30, wherein actuating the downhole tool comprises (i) moving a sliding sleeve to close off production from a selected zone within the completion interval, (ii) moving a sliding sleeve to open up production from a selected zone within the completion interval, (iii) setting a packer, or (iv) manipulating a valve.

37. The method of claim 30, wherein:

the tubular joint comprises a joint of a sand control device also having at least one alternate flow channel; and the method further comprises injecting a gravel slurry into an annular region formed between the sand control device and the surrounding wellbore, while providing that a portion of the gravel slurry travels through the at least one alternate flow channel to allow the gravel slurry to bypass any premature sand bridges.

38. The method of claim 30, further comprising:

releasing a second downhole carrier into the wellbore, the second downhole carrier emitting a second frequency signal;

sensing the second frequency signal at the transmitter-receiver;

in response to the second frequency signal, sending a second instruction signal from the transmitter-receiver to the electrical circuit; and in response to the second instruction signal, sending a second command signal from the electrical circuit to actuate a downhole tool.

39. A method for monitoring conditions in a wellbore, the wellbore having a lower end defining a completion interval, the method comprising:

running a communications module and a connected tubular joint into the wellbore, the communications module comprising:

a pre-programmed electrical circuit, a transmitter-receiver, a sensing device in electrical communication with the electrical circuit, and at least one alternate flow channel configured to allow a gravel slurry to partially bypass the communications module during a gravel packing procedure;

positioning the communications module and the tubular joint along the completion interval of the wellbore;

placing a gravel pack along a substantial portion of the completion interval of the wellbore;

producing hydrocarbon fluids from the completion interval of the wellbore;

sensing a downhole condition during production operations;

sending readings of the sensed downhole conditions from the sensing device to the electrical circuit;

sending the readings from the electrical circuit to the transmitter-receiver;

releasing a downhole carrier into the wellbore;

transmitting the readings from the transmitter-receiver to the downhole carrier;

retrieving the downhole carrier from the wellbore; and downloading the recorded readings for data analysis.

40. The method of claim 39, wherein the completion interval is along a section of perforated production casing.

41. The method of claim 39 wherein the completion interval is along an open-hole portion of the wellbore.

42. The method of claim 39, wherein:

the pre-programmed electrical circuit is an RFID circuit;

the downhole carrier is an RFID tag that receives a radio-frequency signal; and the transmitter-receiver is an RF antenna.

43. The method of claim 39, wherein releasing the downhole carrier comprises releasing the downhole carrier from the wellbore at or below the communications module.

44. The method of claim 43, further comprising:

pumping a tag from a surface into the wellbore, the tag emitting a first frequency signal;

sensing the first frequency signal at the transmitter-receiver; and in response to sensing the first frequency signal, releasing the downhole carrier into the wellbore.

45. The method of claim 39, wherein releasing a downhole carrier comprises pumping, releasing, or dropping the downhole carrier from a surface into the wellbore and down to the communications module.

46. The method of claim 39, wherein:

the tubular joint comprises a joint of a sand control device also having at least one alternate flow channel; and the step of placing a gravel pack comprises injecting a gravel slurry into an annular region formed between the sand control device and the surrounding wellbore, while providing that a portion of the gravel slurry travels through the at least one alternate flow channel to allow the gravel slurry to at least partially bypass any premature sand bridges.

47. The method of claim 39, wherein the tubular joint comprises a zonal isolation packer also having at least one alternate flow channel.

* * * * *